US011692674B2

(12) United States Patent
Kamei et al.

(10) Patent No.: US 11,692,674 B2
(45) Date of Patent: Jul. 4, 2023

(54) LIGHT-EMITTING ELEMENT, LIGHTING DEVICE, AND METHOD FOR MANUFACTURING LIGHTING DEVICE AND DISPLAY DEVICE

(71) Applicant: Japan Display Inc., Tokyo (JP)

(72) Inventors: Yoshifumi Kamei, Tokyo (JP); Yoshikatsu Imazeki, Tokyo (JP); Yoichi Kamijo, Tokyo (JP); Koichi Miyasaka, Tokyo (JP); Shuichi Osawa, Tokyo (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 17/949,282

(22) Filed: Sep. 21, 2022

(65) Prior Publication Data

US 2023/0019409 A1 Jan. 19, 2023

Related U.S. Application Data

(63) Continuation of application No. PCT/JP2021/007954, filed on Mar. 2, 2021.

(30) Foreign Application Priority Data

Mar. 26, 2020 (JP) ..... 2020-055546

(51) Int. Cl.
*F21K 2/08* (2006.01)

(52) U.S. Cl.
CPC ..... *F21K 2/08* (2013.01)

(58) Field of Classification Search
CPC .. F21K 2/08; G09F 9/00; H05B 33/02; H05B 33/04; H05B 33/10; H05B 33/12; H10K 50/00; H10K 59/00
See application file for complete search history.

(56) References Cited

FOREIGN PATENT DOCUMENTS

| | | | | |
|---|---|---|---|---|
| CN | 110444674 A | * | 11/2019 | ..... H01L 51/0032 |
| JP | 2000-067601 A | | 3/2000 | |
| JP | 2011-103234 A | | 5/2011 | |

OTHER PUBLICATIONS

English Machine Translation of Meng, CN110444674 (Year: 2023).*
International Search Report dated Apr. 27, 2021 for the corresponding PCT Application No. PCT/JP2021/007954, with English translation.

* cited by examiner

*Primary Examiner* — Donald L Raleigh

(74) *Attorney, Agent, or Firm* — Michael Best & Friedrich LLP

(57) ABSTRACT

Disclosed is a light-emitting element including a first electrode, a first light-emitting layer, an ionic-liquid layer, a second light-emitting layer, and a second electrode. The first light-emitting layer is located over the first electrode and includes a first emissive polymer and an ionic liquid. The ionic-liquid layer is located over the first light-emitting layer and includes an ionic liquid. The second light-emitting layer is located over the ionic-liquid layer and includes a second emissive polymer and an ionic liquid. The second electrode is located over the second light-emitting layer. The light-emitting element may further include a first substrate under the first electrode, a second substrate over the second electrode, and a sealing layer located between the first substrate and the second substrate and surrounding the first electrode.

15 Claims, 18 Drawing Sheets

LIGHT-EMITTING ELEMENT, LIGHTING DEVICE, AND METHOD FOR MANUFACTURING LIGHTING DEVICE AND DISPLAY DEVICE

CROSS REFERENCE TO RELATED APPLICATIONS

This application is a Continuation of International Patent Application No. PCT/JP2021/007954, filed on Mar. 2, 2021, which claims priority to Japanese Patent Application No. 2020-055546, filed on Mar. 26, 2020, the entire contents of which are incorporated herein by reference.

FIELD

An embodiment of the present invention relates to a light-emitting element, a lighting device or a display device including the light-emitting element, and a manufacturing method of the lighting device or the display device.

BACKGROUND

As a light-emitting element, a light-emitting electrochemical cell (LEC) has been known. A light-emitting electrochemical cell has a structure in which a mixture of an emissive organic compound and an ionic liquid is sandwiched between a pair of electrodes. Electrons and holes are injected to the emissive organic compound by applying a direct current or an alternating current between the pair of electrodes, and light emission is obtained when the electrons and holes recombine (see Japanese Patent Applications No. 2011-103234 and 2000-67601.

SUMMARY

An embodiment of the present invention is a light-emitting element. The light-emitting element includes a first electrode, a first light-emitting layer, an ionic-liquid layer, a second light-emitting layer, and a second electrode. The first light-emitting layer is located over the first electrode and includes a first emissive polymer and an ionic liquid. The ionic-liquid layer is located over the first light-emitting layer and includes an ionic liquid. The second light-emitting layer is located over the ionic-liquid layer and includes a second emissive polymer and an ionic liquid. The second electrode is located over the second light-emitting layer.

An embodiment of the present invention is a lighting device. The lighting device includes a first substrate, at least one first electrode, a first light-emitting layer, an ionic-liquid layer, a second light-emitting layer, at least one second electrode, a second substrate, and a sealing layer. The at least one first electrode is located over the first substrate. The first light-emitting layer is located over the at least one first electrode and includes a first emissive polymer and an ionic liquid. The ionic-liquid layer is located over the first light-emitting layer and includes an ionic liquid. The second light-emitting layer is located over the ionic-liquid layer and includes a second emissive polymer and an ionic liquid. The at least one second electrode is located over the second light-emitting layer, and the second substrate is located over the at least one second electrode. The sealing layer is located between the first substrate and the second substrate and surrounds the at least one first electrode.

An embodiment of the present invention is a method for manufacturing a lighting device. This method includes: forming a first electrode over a first substrate; forming a resin surrounding the first electrode over the first substrate; forming a first light-emitting layer including a first emissive polymer and an ionic liquid over the first electrode; forming a second electrode over a second substrate; forming a second light-emitting layer including a second emissive polymer and an ionic liquid over the second electrode; forming an ionic-liquid layer including an ionic liquid over the first light-emitting layer or the second light-emitting layer; bonding the first substrate and the second substrate so that the ionic-liquid layer is sandwiched by the first substrate and the second substrate; and curing the resin.

An embodiment of the present invention is a method for manufacturing a display device. This method includes: forming a pixel including a first electrode over a first substrate; forming a resin surrounding the pixel over the first substrate; forming a first light-emitting layer including a first emissive polymer and an ionic liquid over the first electrode; forming a second electrode over a second substrate; forming a second light-emitting layer including a second emissive polymer and an ionic liquid over the second electrode; forming an ionic-liquid layer including an ionic liquid over the first light-emitting layer or the second light-emitting layer; bonding the first substrate and the second substrate so that the ionic-liquid layer is sandwiched by the first substrate and the second substrate; and curing the resin.

An embodiment of the present invention is a display device. The display device includes a backlight unit and a liquid crystal module over the backlight unit. The backlight unit includes a first substrate, at least one first electrode, a first light-emitting layer, an ionic-liquid layer, a second light-emitting layer, a second electrode, a second substrate, and a sealing layer. The at least one first electrode is located over the first substrate. The first light-emitting layer is located over the at least one first electrode and includes a first emissive polymer and an ionic liquid. The ionic-liquid layer is located over the first light-emitting layer and includes an ionic liquid. The second light-emitting layer is located over the ionic-liquid layer and includes a second emissive polymer and an ionic liquid. The second electrode is located over the second light-emitting layer, and the second substrate is located over the second electrode. The sealing layer is located between the first substrate and the second substrate and surrounds the at least one first electrode.

An embodiment of the present invention is a display device. The display device includes a first substrate, at least one pixel, a second substrate, and a sealing layer. The at least one pixel is located over the first substrate, and the second substrate is located over the at least one pixel. The sealing layer is located between the first substrate and the second substrate and surrounds the pixel. The at least one pixel includes a first electrode, a first light-emitting layer, an ionic-liquid layer, a second light-emitting layer, and a second electrode. The first light-emitting layer is located over the first electrode and includes a first emissive polymer and an ionic liquid. The ionic-liquid layer is located over the first light-emitting layer and includes an ionic liquid. The second light-emitting layer is located over the ionic-liquid layer and includes a second emissive polymer and an ionic liquid. The second electrode is located over the second light-emitting layer.

DESCRIPTION OF EMBODIMENTS

Hereinafter, each embodiment of the present invention is explained with reference to the drawings. The invention can be implemented in a variety of different modes within its concept and should not be interpreted only within the disclosure of the embodiments exemplified below.

The drawings may be illustrated so that the width, thickness, shape, and the like are illustrated more schematically compared with those of the actual modes in order to provide a clearer explanation. However, they are only an example, and do not limit the interpretation of the invention. In the specification and the drawings, the same reference number is provided to an element that is the same as that which appears in preceding drawings, and a detailed explanation may be omitted as appropriate.

In the specification and the claims, unless specifically stated, when a state is expressed where a structure is arranged "over" another structure, such an expression includes both a case where the substrate is arranged immediately above the "other structure" so as to be in contact with the "other structure" and a case where the structure is arranged over the "other structure" with an additional structure therebetween.

First Embodiment

In the present embodiment, a structure of a light-emitting element 100 according to an embodiment of the present invention is explained. The light-emitting element 100 is a so-called light-emitting electrochemical cell.

1. Structure

Figure 1A:
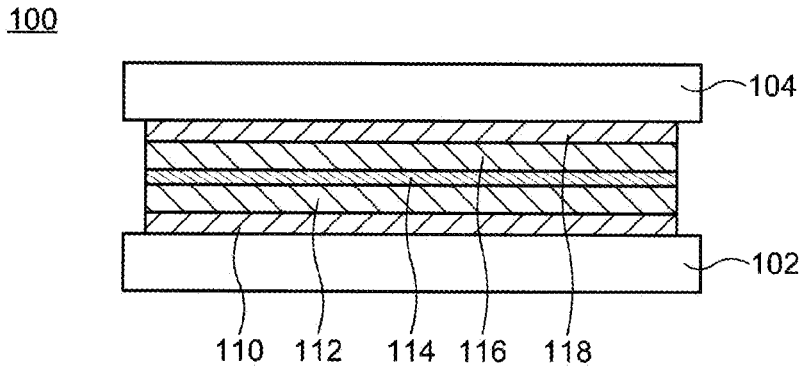
FIG. 1A is a schematic cross-sectional view of a light-emitting element according to an embodiment of the present invention.

A schematic cross-sectional view of the light-emitting element 100 is shown in FIG. 1A. As demonstrated in FIG. 1A, the light-emitting element 100 includes a first electrode 110, a first light-emitting layer 112 over the first electrode 110, an ionic-liquid layer 114 over the first light-emitting layer 112, a second light-emitting layer 116 over the ionic-liquid layer 114, and a second electrode 118 over the second light-emitting layer 116 as fundamental components. The first electrode 110, the first light-emitting layer 112, the ionic-liquid layer 114, and the second light-emitting layer 116 may be in contact with the first light-emitting layer 112, the ionic-liquid layer 114, the second light-emitting layer 116, and the second electrode 118, respectively. In addition, the first light-emitting layer 112 and the second light-emitting layer 116 may be completely spaced away from each other or may be partly in contact with each other although not illustrated. The light-emitting element 100 may be disposed over a substrate (first substrate) 102, and a counter substrate (second substrate) 104 for protecting the light-emitting element 100 may be arranged over the second electrode 118. Moreover, the light-emitting element 100 may include a sealing layer between the substrate 102 and the counter substrate 104 so as to fix the substrate 102 and the counter substrate 104 and surround the light-emitting element 100 although not illustrated. Since the sealing layer of the light-emitting element 100 has the same structure as the sealing layer 126 in the Second Embodiment, an explanation thereof is omitted in this embodiment.

2. First Electrode and Second Electrode

The first electrode 110 and the second electrode 118 each have a function to inject carriers (electrons and holes) to the first light-emitting layer 112 and the second light-emitting layer 116, respectively, and may include a metal such as aluminum, copper, titanium, molybdenum, tungsten, tantrum, silver, and magnesium or an alloy including a metal selected therefrom, for example. Alternatively, the first electrode 110 and the second electrode 118 may each include a conductive oxide such as indium-tin oxide (ITO) and indium-zinc oxide (IZO). The materials included in the first electrode 110 and the second electrode 118 may be the same as or different from each other. For example, when the first electrode 110 and the second electrode 118 are formed with a conductive oxide capable of transmitting visible light or with a film of a metal or an alloy having a thickness allowing visible light to pass therethrough, by which the emission obtained from the first light-emitting layer 112 and/or the second light-emitting layer 116 can be extracted through both electrodes. Alternatively, one of the first electrode 110 and the second electrode 118 is configured to transmit visible light, while the other is configured to reflect visible light using a metal or an alloy, by which the emission can be selectively extracted from the former electrode.

3. First Light-Emitting Layer and Second Light-Emitting Layer

The first light-emitting layer 112 and the second light-emitting layer 116 each include an emissive polymer and an ionic liquid. Thicknesses of the first light-emitting layer 112 and the second light-emitting layer 116 are each selected from a range equal to or more than 50 nm and equal to or less than 300 nm, equal to or more than 50 nm and equal to or less than 200 nm, or equal to or more than 100 nm and equal to or less than 150 nm.

As an emissive polymer, a polymer which emits visible light when relaxing from an excited state to a ground state can be used. As an example, a conjugated polymer having π-conjugated multiple bonds in a main chain is represented. As a conjugated polymer, a poly(arylene vinylene), a polyarylene, polyacetylene, polythiophene, polypyrrole, polypyridine, polypyrimidine, a poly(ethynylene vinylene), polyaniline, and their derivatives are represented, for example. Alternatively, a G-conjugated polymer such as a polysilane may be used. Alternatively, a vinyl polymer with a luminophore having a π-conjugated system in a side chain such as poly(vinyl carbazole) may be employed. The structures of the emissive polymer (first emissive polymer) included in the first light-emitting layer 112 and the emissive polymer (second emissive polymer) included in the second light-emitting layer 116 may be the same as or different from each other.

The ionic liquid is liquid at a normal temperature (e.g., 20° C.) and is an organic electrolyte which polarizes when a potential difference is provided between the first electrode 110 and the second electrode 118. For example, when the first electrode 110 is applied with a voltage positively larger than the voltage of the second electrode 118, cations and anions of the ionic liquid are localized at vicinities of the second electrode 118 and the first electrode 110, respectively, resulting in p-type and n-type electric double layers at vicinities of the first electrode 110 and the second electrode 118, respectively. An electric field generated by the electric double layers drastically reduces the resistance between the first electrode 110 and the second electrode 118, which facilitates the injection of the holes and electrons to the first light-emitting layer 112 and the second light-emitting layer 116, respectively.

As an ionic liquid, onium salts can be used. More specifically, an ammonium salt, an imidazolium salt, a sulfonium salt, a pyrazinium salt, a pyridinium salt, a pyrrolidinium salt, a phosphonium salt, or a piperidinium salt may be used. As a counter anion of these onium salts, tetrafluoroborate, acetate, trifluoroacetate, hexafluorophosphate, triflate, nitrate, perchlorate, bromide, chloride, bis(trifluoromethanesulfonyl)imidate, and the like are represented. The ionic liquid exists in a matrix of the emissive polymer in the first light-emitting layer 112 and the second light-emitting layer 116. That is, the emissive polymer exists in a state swelled with the ionic liquid.

In each of the first light-emitting layer 112 and the second light-emitting layer 116, a weight ratio of the emissive polymer and the ionic liquid (emissive polymer:ionic liquid) may be appropriately selected in a rage from 10:1 to 1:1, from 5:1 to 1:1, or from 4:1 to 2:1, for example. The ionic liquid (first ionic liquid) included in the first light-emitting layer 112 and the ionic liquid (second ionic liquid) included in the second light-emitting layer 116 may be the same as or different from each other.

4. Ionic-Liquid Layer

The ionic-liquid layer 114 includes an ionic liquid. A thickness of the ionic-liquid layer 114 is appropriately selected from a range equal to or more than 10 nm and equal to or less than 50 nm, equal to or more than 10 nm and equal to or less than 30 nm, or equal to or more than 10 nm and equal to or less than 20 nm. The ionic liquid included in the ionic-liquid layer 114 may be the same as or different from the ionic liquid included in the first light-emitting layer 112 or the second light-emitting layer 116. In addition, two or more kinds of ionic liquids may be included in the ionic-liquid layer 114.

5. Substrate and Counter Substrate

The substrate 102 supporting the light-emitting element 100 and the counter substrate 104 protecting the light-emitting element 100 may include glass, quartz, a metal such as aluminum, copper, stainless steel, or a polymer such as a polyimide, a polyamide, a polycarbonate, and an acrylic resin. The substrate 102 and the counter substrate 104 may be configured to have a sufficient strength to prevent deformation or may have flexibility so as to be readily deformed. In the latter case, a substrate including a polymer or a glass or metal substrate with a thickness adjusted to be readily deformed may be used. Materials included in the substrate 102 and the counter substrate 104 may be the same as or different from each other. For example, the substrate 102 and the counter substrate 104 may be configured so that one includes glass while the other includes a metal or a polymer. The light-emitting element 100 may also be configured so that the substrate 102 and the counter substrate 104 each include a metal and at least one of them has a thickness allowing visible light to pass therethrough.

6. Modified Example

Figure 1B:
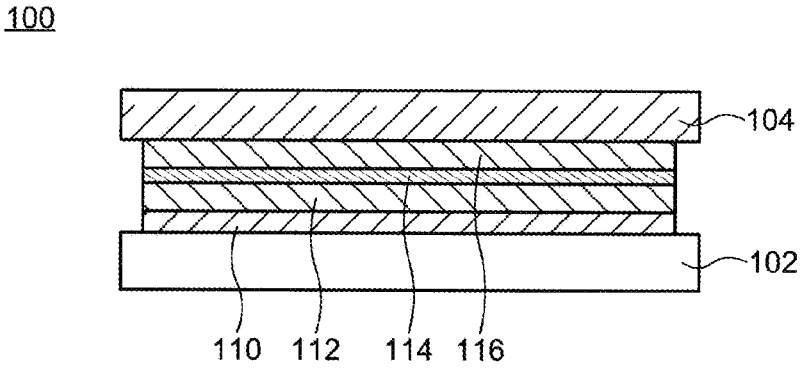
FIG. 1B is a schematic cross-sectional view of a light-emitting element according to an embodiment of the present invention.

The structure of the light-emitting element 100 is not limited to that described above. For example, a substrate including a metal such as aluminum, copper, and stainless steel may be used as one of the substrates (e.g., the counter substrate 104 in FIG. 1B) to allow this substrate to function as one of the electrodes (the second electrode 118 in FIG. 1B) as shown in FIG. 1B. Hence, the light-emitting element 100 can be structured even if no electrode is disposed over the substrate including a metal in this modified example.

Figure 1C:
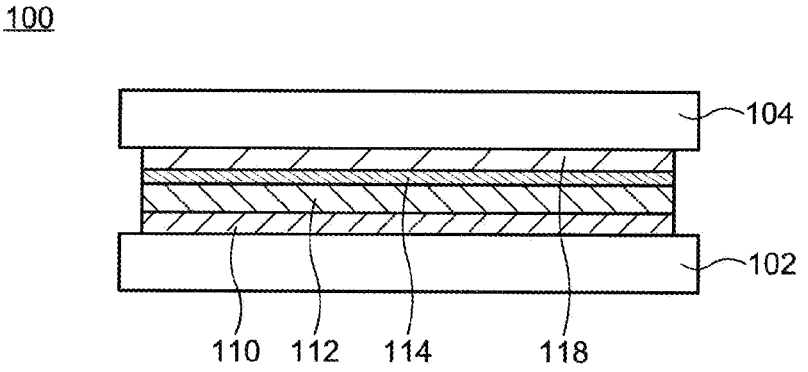
FIG. 1C is a schematic cross-sectional view of a light-emitting element according to an embodiment of the present invention.
Figure 10:
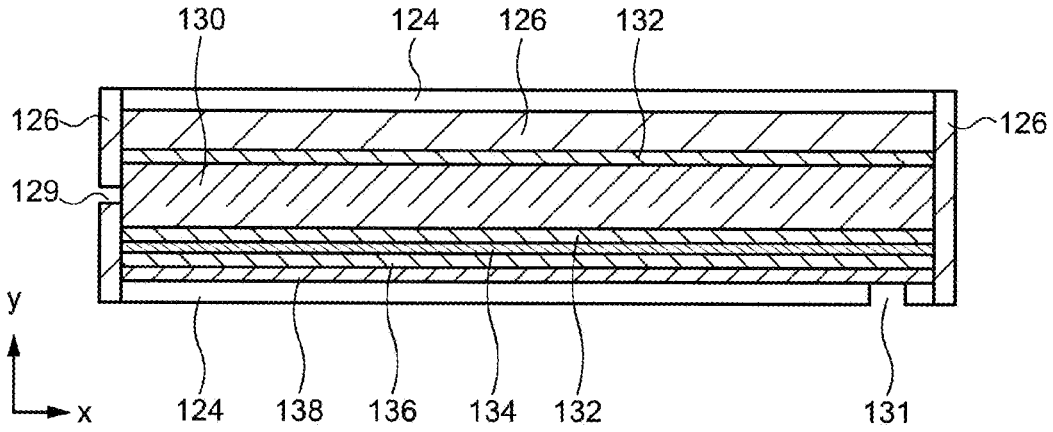
FIG. 10 is a schematic cross-sectional view of a lighting device according to an embodiment of the present invention.

Alternatively, one of the first light-emitting layer 112 and the second light-emitting layer 116 (the second light-emitting layer 116 in the example of FIG. 1C) may not be formed as shown in FIG. 10. In this case, the ionic-liquid layer 114 is in contact with one of the first electrode 110 and the second electrode 118.

Generally, a light-emitting electrochemical cell is prepared by forming a single light-emitting layer including an emissive polymer and an ionic liquid over a first electrode, followed by forming a second electrode over the light-emitting layer using a sputtering method or an evaporation method. Therefore, the light-emitting layer is damaged during the formation of the second electrode, resulting in a decrease in flatness of the surface of the light-emitting layer. This damage is caused by the heat generated during the formation of the second electrode. The formation of depressions and projections on the surface of the light-emitting layer readily leads to defects such as a short circuit between the first electrode and the second electrode, formation of emission unevenness, and formation of a non-emissive region.

On the contrary, it is possible to effectively suppress the aforementioned defects in the light-emitting element 100. As demonstrated by a manufacturing method of the light-emitting element 100 described as a manufacturing method of a lighting device including the light-emitting element 100 in the Second Embodiment, the light-emitting element 100 having the aforementioned structures is manufactured by respectively forming the first light-emitting layer 112 and the second light-emitting layer 116 over the first electrode 110 and the second electrode 118 followed by overlapping and fixing the first electrode 110 and the second electrode 118 to each other so that the ionic-liquid layer 134 is sandwiched by the first electrode 110 and the second electrode 118. Therefore, the probability of generating damage to the first light-emitting layer 112 and the second light-emitting layer 116 can be remarkably reduced during the manufacture of the light-emitting element 100. Accordingly, a decrease in flatness caused by the formation of the second electrode 118 does not occur. In addition, the ionic-liquid layer 134 is capable of functioning as a buffer, which prevents the interelectrode short circuit even if depressions and projections are generated on the surfaces of the first light-emitting layer 112 and the second light-emitting layer 116 during the formation thereof. Hence, employment of the aforementioned structures suppresses the emission unevenness and enables the production of a highly reliable light-emitting element.

Second Embodiment

In the present embodiment, a structure of a lighting device 120 including the light-emitting element 100 and a manufacturing method thereof are explained. Since the light-emitting element 100 can be manufactured by a similar method to the lighting device 120, an explanation of a manufacturing method of the light-emitting element 100 is omitted. An explanation of the structures the same as or similar to those described in the First Embodiment may also be omitted.

1. Structure

Figure 2:
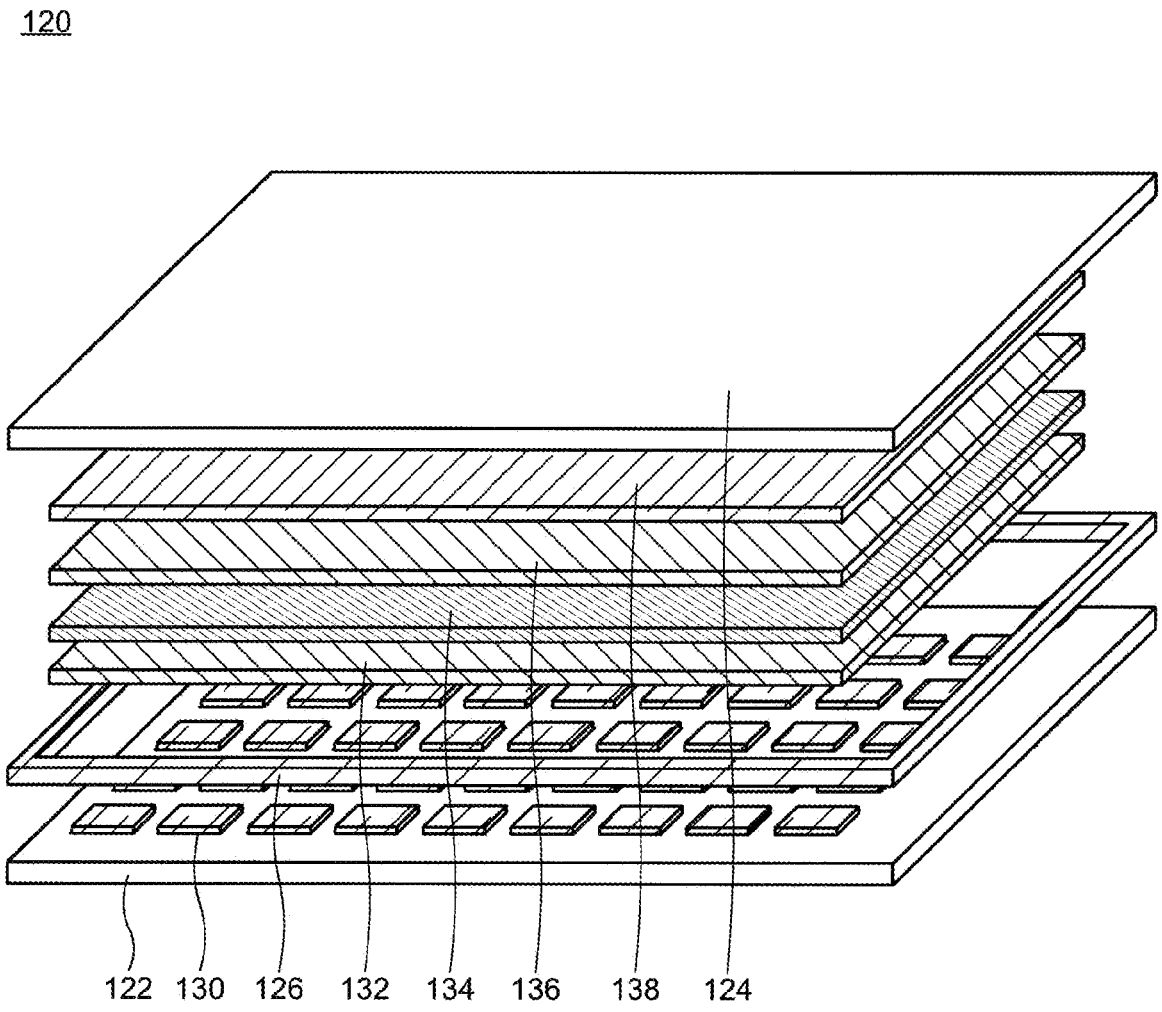
FIG. 2 is a schematic developed view of a lighting device according to an embodiment of the present invention.
Figure 3A:
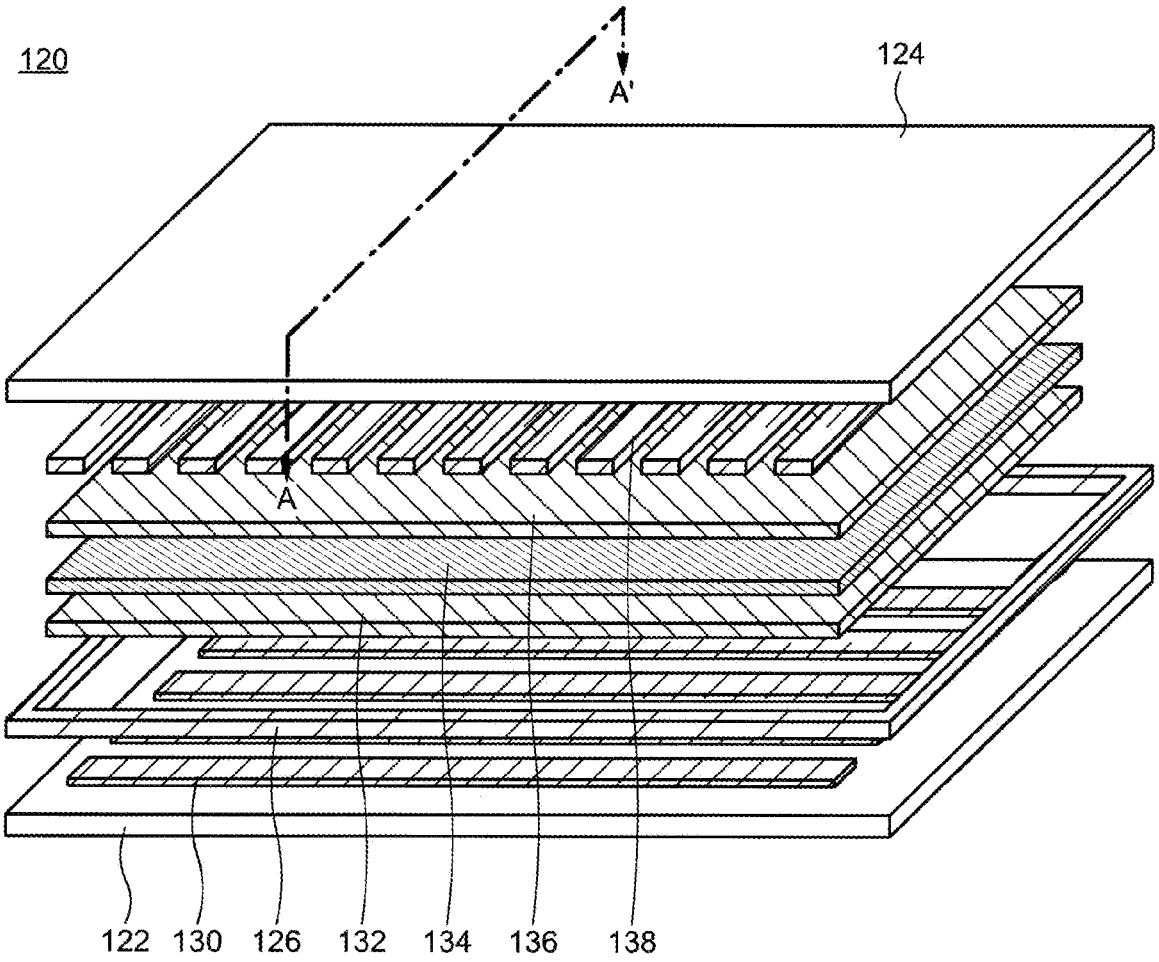
FIG. 3A is a schematic developed view of a lighting device according to an embodiment of the present invention.

A structure of the lighting device 120 is explained using schematic developed views in FIG. 2 and FIG. 3A. As shown in FIG. 2, the lighting device 120 has a substrate (first substrate) 122, at least one first electrode 130, the sealing layer 126, a first light-emitting layer 132, an ionic-liquid layer 134, a second light-emitting layer 136, at least one second electrode 138, and a counter substrate (second electrode) 124. The substrate 122, first electrode 130, first light-emitting layer 132, ionic-liquid layer 134, second light-emitting layer 136, second electrode 138, and counter substrate 124 respectively correspond to the substrate 102, the first electrode 110, the first light-emitting layer 112, the ionic-liquid layer 114, the second light-emitting layer 116, the second electrode 118, and the counter substrate 104 of the light-emitting element 100 (see FIG. 1A). The light-emitting element 100 shown in FIG. 1A and so on is structured by the first electrode 130, the first light-emitting layer 132, the ionic-liquid layer 134, the second light-emitting layer 136, and the second electrode 138.

The first electrode 130 is formed over the substrate 122. The at least one first electrode 130 may include a plurality of first electrodes 130. In this case, the plurality of first electrodes 130 may be arranged in a matrix form as shown in FIG. 2 or in a stripe form as shown in FIG. 3A. The second electrode 138 may be single. In this case, the second electrode 138 is disposed to overlap the plurality of first electrodes 130 as shown in FIG. 2. Alternatively, the at least one second electrode 138 may include a plurality of second electrodes 138 arranged in a stripe form as shown in FIG. 3A. When the plurality of second electrodes 138 is arranged in a stripe form, the first electrodes 130 and the second electrodes 138 may be configured so that the extending directions thereof intersect each other.

The sealing layer 126 includes a cured resin. As the resin, a photosensitive or thermosetting epoxy resin, silicon resin, acrylic resin, and the like are represented, for example. The sealing layer 126 is disposed to surround the first electrode 130 and fixes the substrate 122 and the counter substrate 124. It is possible to prevent the entrance of impurities such as water and oxygen from the outside by providing the sealing layer 126.

Figure 3B:
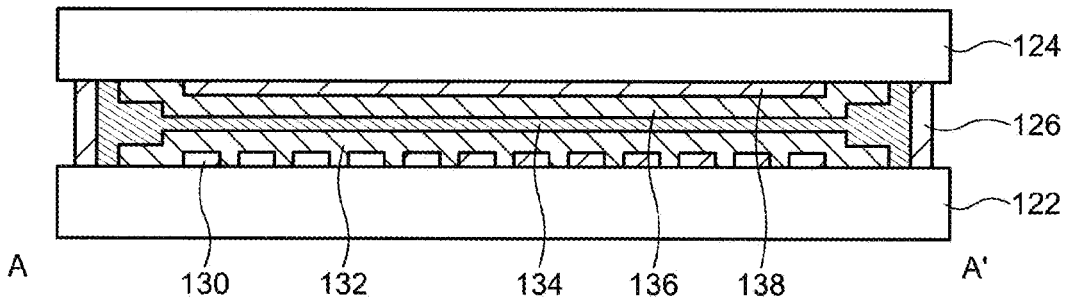
FIG. 3B is a schematic cross-sectional view of a lighting device according to an embodiment of the present invention.

A schematic view of a cross section along a chain line A-A' in FIG. 3A is shown in FIG. 3B. As shown in this drawing, the first electrode 130 and the second electrode 138 are respectively covered with the first light-emitting layer 132 and the second light-emitting layer 136. The ionic-liquid layer 134 is arranged between the first light-emitting layer 132 and the second light-emitting layer 136 and is sealed in a space surrounded by the substrate 122, the counter substrate 124, and the sealing layer 126.

2. Manufacturing Method

A manufacturing method of the lighting device 120 shown in FIG. 3A is explained as a manufacturing method of the lighting device according to an embodiment of the present invention using FIG. 4A to FIG. 4D.

Figure 4A:
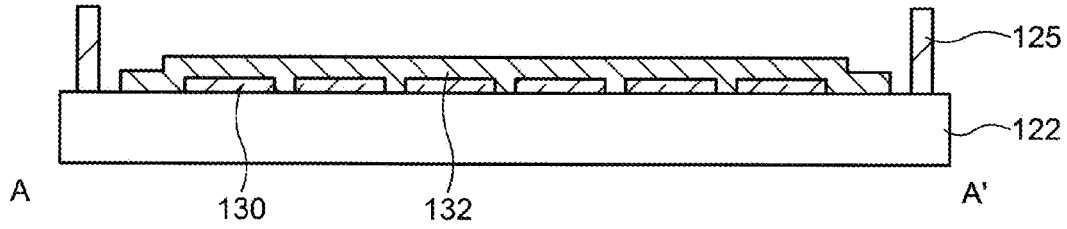
FIG. 4A is a schematic cross-sectional view showing a manufacturing method of a lighting device according to an embodiment of the present invention.

First, the first electrode 130 is formed over the substrate 122 (FIG. 4A). The first electrode 130 may be formed utilizing a method commonly used in the manufacture of a variety of semiconductor devices, such as a sputtering method and a chemical vapor deposition (CVD) method. Although not illustrated, an undercoat may be formed over the substrate 122 over which the first electrode 130 may be formed. The undercoat is structured with a single or a plurality of films each including a silicon-containing inorganic compound such as silicon nitride and silicon oxide or the like. The formation of the undercoat makes it possible to prevent impurities included in the first electrode 130 from entering the light-emitting element 100.

After that, the sealing layer 126 is formed over the substrate 122. Specifically, a photosensitive or thermoplastic resin 125 which is not yet cured is applied on the substrate 122 by utilizing an ink-jet method, a printing method, or the like. The resin 125 may be applied so that a closed shape is drawn over the substrate 122 (see FIG. 2 and FIG. 3A)

After that, the first light-emitting layer 132 is disposed over the first electrode 130. Specifically, the emissive polymer is dissolved in an organic solvent, and the ionic liquid is added thereto to prepare a mixture. This mixture may be homogeneous or inhomogeneous. The organic solvent may be selected from common organic solvents exemplified by aromatic hydrocarbons such as toluene, xylene, and tetralin, halogenated aromatic hydrocarbons such as chlorobenzene and dichlorobenzene, halogenated alkanes such as chloroform, dichloromethane, and 1,2-dichloroethane, and ethers such as tetrahydrofuran and dioxane. This mixture is applied in a region surrounded by the resin 125 by utilizing a spin-coating method, a spray method, an ink-jet method, a printing method, or the like. After that, the organic solvent is evaporated, leading to the formation of the first light-emitting layer 132 including the emissive polymer and the ionic liquid. Evaporation of the organic solvent may be conducted at a normal pressure or a reduced pressure. Moreover, the substrate 122 may be heated during evaporation of the organic solvent.

Figure 4B:
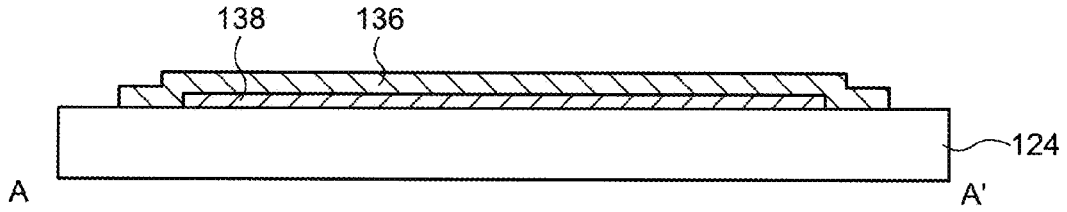
FIG. 4B is a schematic cross-sectional view showing a manufacturing method of a lighting device according to an embodiment of the present invention.

Similarly, the second electrode 138 is formed over the counter substrate 124. Similar to the formation of the first electrode 130, an undercoat may be formed over the counter substrate 124 prior to the formation of the second electrode 138. After that, the second light-emitting layer 136 is formed over the second electrode 138 (FIG. 4B). The formation of the second electrode 138 and the second light-emitting layer 136 may be carried out with the same method as the first electrode 130 and the first light-emitting layer 132. Note that the resin 125 may not be formed over the substrate 122 but may be formed over the counter substrate 124.

Figure 4C:
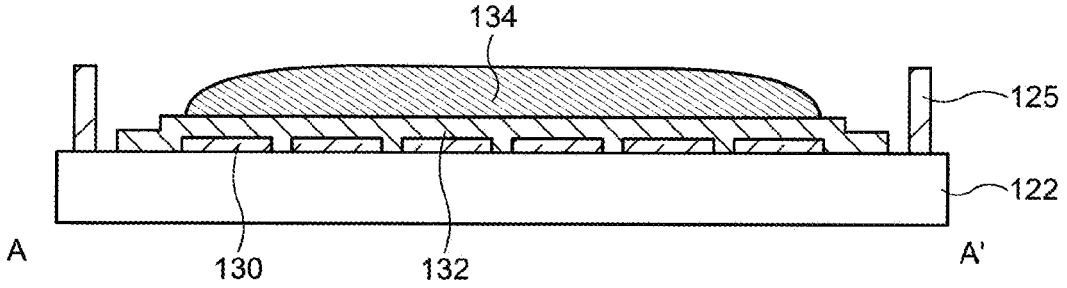
FIG. 4C is a schematic cross-sectional view showing a manufacturing method of a lighting device according to an embodiment of the present invention.

Next, the ionic-liquid layer 134 is provided over the first light-emitting layer 132 (FIG. 4C). Specifically, the ionic liquid is applied in the region surrounded by the resin 125, and then spread. At this time, although a spray method, an ink-jet method, a printing method, a spin-coating method, or the like may be used, the ionic liquid may be dropped over the first light-emitting layer 132 by utilizing the one-drop-fill (OD) method commonly used for the manufacture of liquid crystal displays. When the resin 125 is formed over the counter substrate 124, the ionic liquid may be applied or dropped on the second light-emitting layer 136.

Figure 4D:
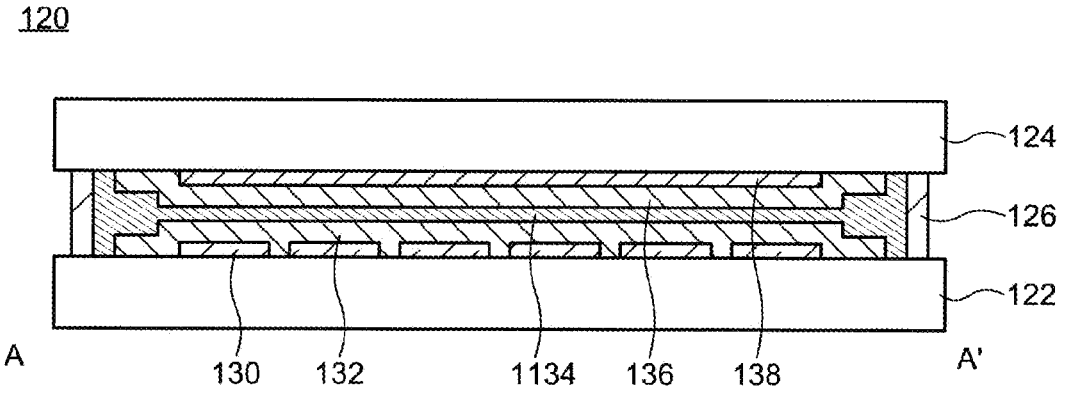
FIG. 4D is a schematic cross-sectional view showing a manufacturing method of a lighting device according to an embodiment of the present invention.

After that, the substrate 122 and the counter substrate 124 are bonded to each other so that the first light-emitting layer 132 and the second light-emitting layer 136 are sandwiched by the substrate 122 and the counter substrate 124. Then, the resin 125 is photocured or thermally cured to form the sealing layer 126, by which the substrate 122 and the counter substrate 124 are simultaneously fixed to each other (FIG. 4D).

Figure 5A:
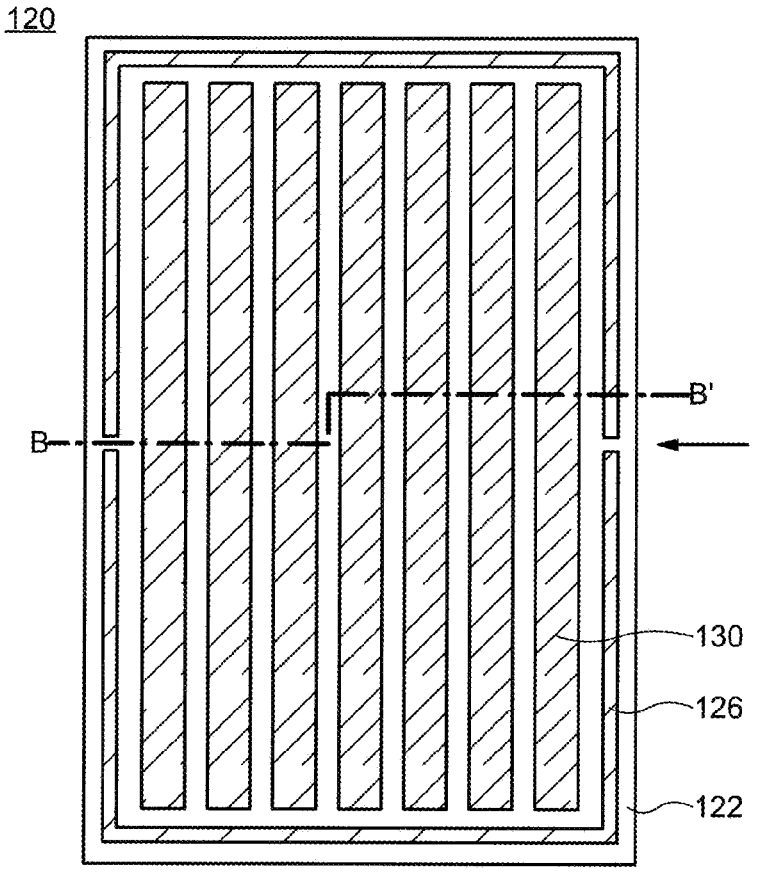
FIG. 5A is a schematic top view of a lighting device according to an embodiment of the present invention.
Figure 5B:
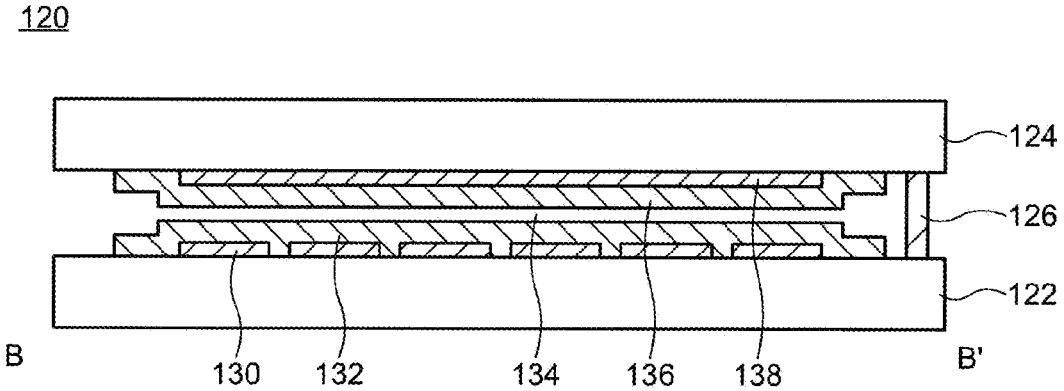
FIG. 5B is a schematic cross-sectional view of a lighting device according to an embodiment of the present invention.

Alternatively, the substrate 122 and the counter substrate 124 may be fixed before forming the ionic-liquid layer 134. In this case, a pair of resins 125 is disposed over the substrate 122 or the counter substrate 124 so as to be spaced away from each other and then the substrate 122 and the counter substrate 124 are bonded before forming the ionic-liquid layer 134 as shown in FIG. 5A and a schematic view (FIG. 5B) of a cross section along a chain line B-B' in FIG. 5A. After that, the sealing layer 126 is cured to form the seal layer 126 and the substrate 122 and the counter substrate 124 are fixed to each other. Hence, the seal layer 126 is composed of two portions, and there are two gaps therebetween. The ionic liquid is injected through one of these gaps and charged in the space formed by the substrate 122, the counter substrate 124, and the sealing layer 126 to form the ionic-liquid layer 134. After injecting the ionic liquid, the resin 125 is provided to fill these gaps and then cured.

As described above, the lighting device 120 is manufactured by respectively forming the first light-emitting layer 132 and the second light-emitting layer 136 over the first electrode 130 and the second electrode 138, followed by bonding the substrate 122 and the counter substrate 124 to sandwich the ionic liquid 134 therebetween. Hence, it is possible to remarkably reduce the probability of damage generation to the first light-emitting layer 132 and the second light-emitting layer 136. In addition, since the ionic-liquid layer 134 is provided between the substrate 122 and the counter substrate 124, the entrance of impurities such as air and water between the substrate 122 and the counter substrate 124 (e.g., between the first light-emitting layer 132 and the second light-emitting layer 136) can be prevented, which contributes to an improvement of the reliability of the light-emitting element 100. Moreover, since the ODF method commonly applied in the manufacturing processes of liquid crystal display devices can be employed when the ionic-liquid layer 134 is formed, the lighting device 120 can be manufactured by utilizing existing manufacturing apparatus for semiconductor devices. Hence, implementation of the present embodiment enables the production of the highly reliable lighting device 120 at a low cost.

3. Modified Example 3-1. Modified Example 1

Figure 6A:
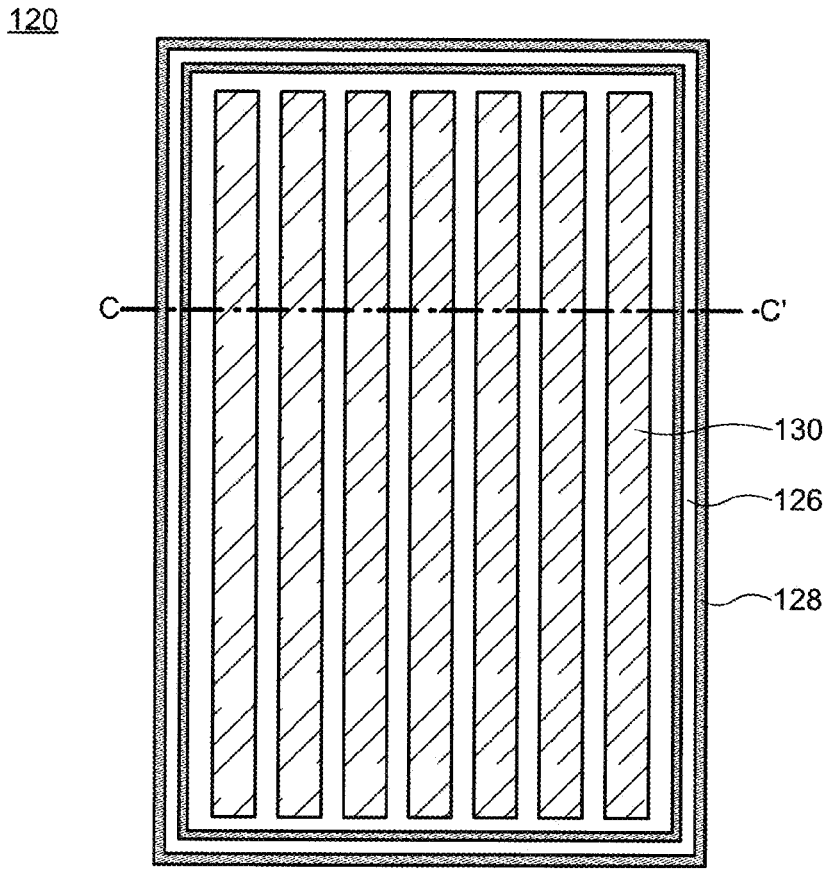
FIG. 6A is a schematic top view of a lighting device according to an embodiment of the present invention.
Figure 6B:
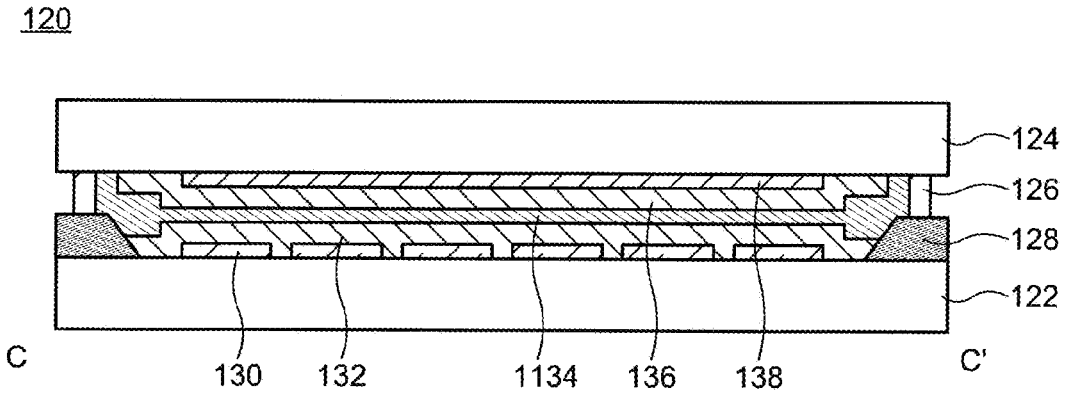
FIG. 6B is a schematic cross-sectional view of a lighting device according to an embodiment of the present invention.

The structure of the lighting device 120 according to the present embodiment is not limited to that described above. For example, as shown in FIG. 6A and a schematic cross-sectional view (FIG. 6B) along a chain line C-C' in FIG. 6A, the lighting device 120 may include a reflection structure 128 between the substrate 122 and the counter substrate 124. The reflection structure 128 contains a metal with a high reflectance with respect to visible light such as aluminum. The reflection structure 128 may also be formed to surround the first electrode 130. The reflection structure 128 may have a closed shape similar to the sealing layer 126, or the lighting device 120 may have a plurality of reflection structures spaced away from one another. The reflection structure 128 is configured so that a width thereof decreases in a direction toward the counter substrate 124 from the substrate 122 in a cross section perpendicular to a top surface of the substrate 122 (FIG. 6B). Hence, the reflection structure 128 has a tapered structure facing in a direction toward the first electrode 130 and is capable of reflecting the light obtained from the first light-emitting layer 132 and the second light-emitting layer 136 at a side surface thereof to direct the light in a direction toward the counter substrate 124. Hence, emission with higher efficiency can be obtained, and the power consumption of the lighting device 120 can be reduced.

When the reflection structure 128 is provided, the sealing layer 126 may be disposed over the reflection structure 128 as shown in FIG. 6A and FIG. 6B. Alternatively, the reflection structure 128 may be disposed in a region surrounded by the sealing layer 126 or may be formed to surround the sealing layer 126 although not illustrated.

3-2. Modified Example 2

Figure 7:
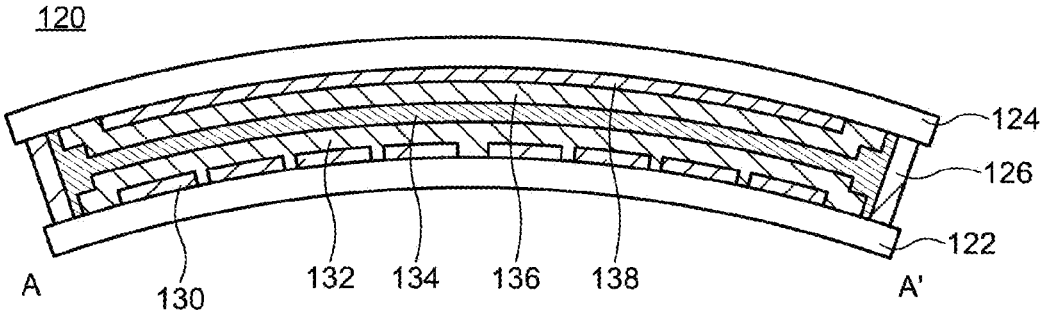
FIG. 7 is a schematic cross-sectional view of a lighting device according to an embodiment of the present invention.

As demonstrated in FIG. 7, the use of the substrate 122 and the counter substrate 124 with flexibility provides flexibility to the lighting device 120. Thus, the whole of or a part of the lighting device 120 may have a bent structure.

Figure 8A:
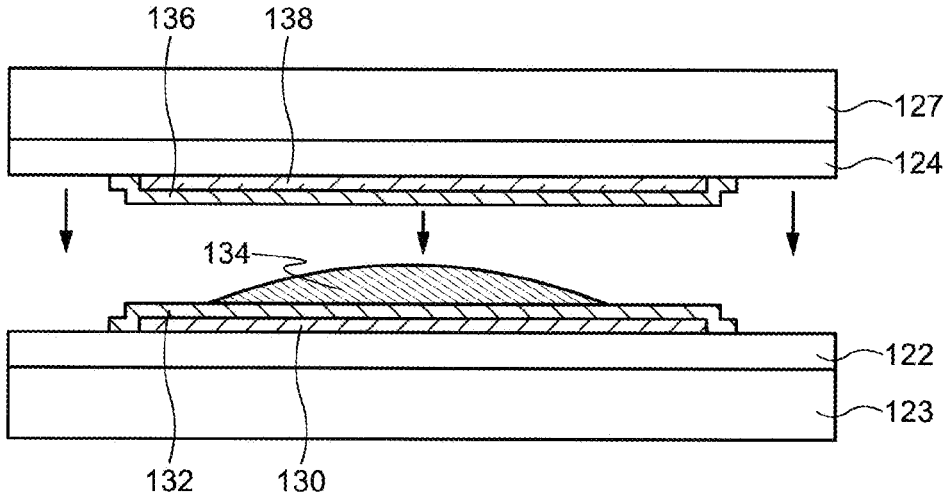
FIG. 8A is a schematic cross-sectional view showing a manufacturing method of a lighting device according to an embodiment of the present invention.
Figure 8B:
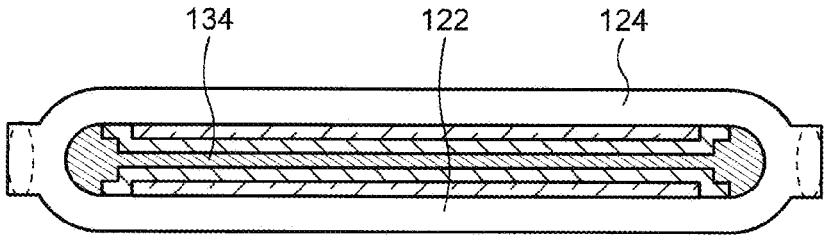
FIG. 8B is a schematic cross-sectional view showing a manufacturing method of a lighting device according to an embodiment of the present invention.
Figure 8C:
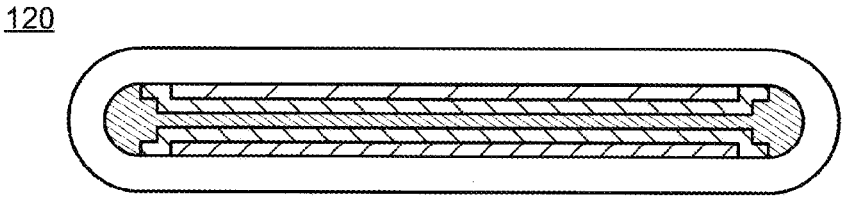
FIG. 8C is a schematic cross-sectional view showing a manufacturing method of a lighting device according to an embodiment of the present invention.

The use of a polymer for the substrate 122 and the counter substrate 124 enables the substrate 122 and the counter substrate 124 to be fixed to each other even though the sealing layer 126 is not used, which enables the production of the flexible lighting device 120 having an edge portion composed of a bent surface. Specifically, the first electrode 130 and the first light-emitting layer 132 are disposed over the flexible substrate 122 provided over a supporting substrate 123 such as a glass substrate, and then the ionic-liquid layer 134 is spread over the first light-emitting layer 132 as shown in FIG. 8A. In a similar way, the second electrode 138 and the second light-emitting layer 136 are also formed over the flexible counter substrate 124 provided over a supporting substrate 127 such as a glass substrate. After that, the substrate 122 and the counter substrate 124 are bonded to each other. The edge portions of the substrate 122 and the counter substrate 124 are crimpled after the supporting substrates 123 and 127 are removed (FIG. 8B). If necessary, the edge portions may be heated when crimping. After that, the seams formed during crimping (the portions surrounded by dotted ellipses in FIG. 8B) are removed, resulting in the formation of the lighting device 120 having bent surfaces at the edge portions as shown in FIG. 8C. Note that light such as laser light may be applied to the substrate 122 and the counter substrate 124 before removing the supporting substrates 123 and 127 to reduce the adhesion between the supporting substrate 123 and the substrate 122 and between the supporting substrate 127 and the counter substrate 124.

3-3. Modified Example 3

Figure 9A:
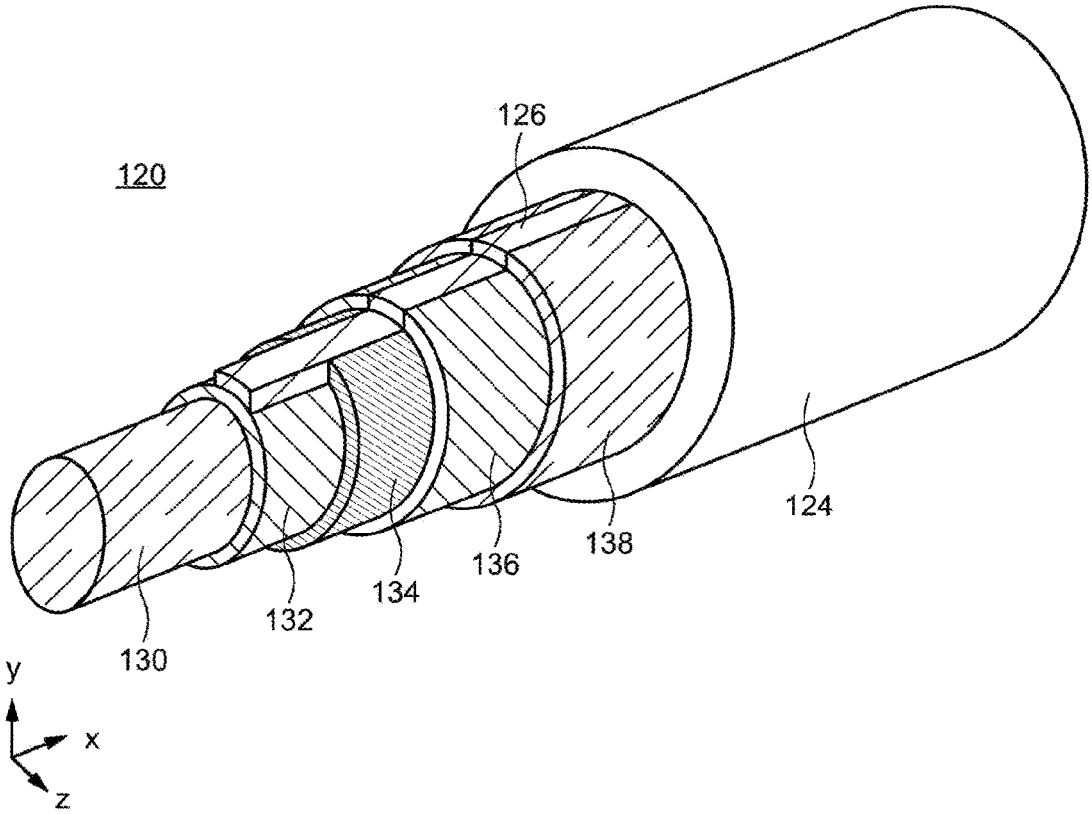
FIG. 9A is a schematic perspective view of a lighting device according to an embodiment of the present invention.
Figure 9B:
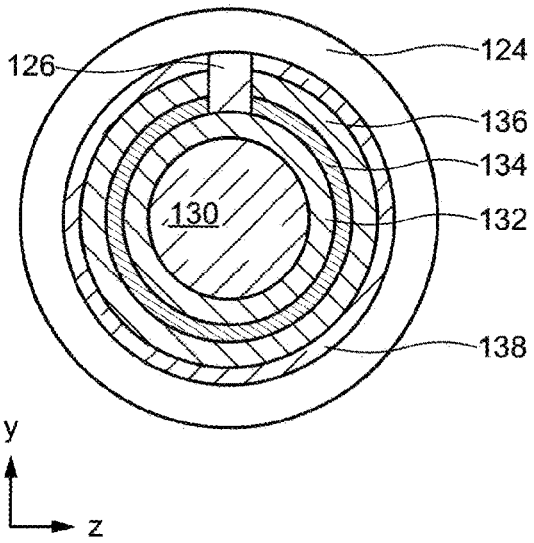
FIG. 9B is a schematic cross-sectional view of a lighting device according to an embodiment of the present invention.
Figure 9C:
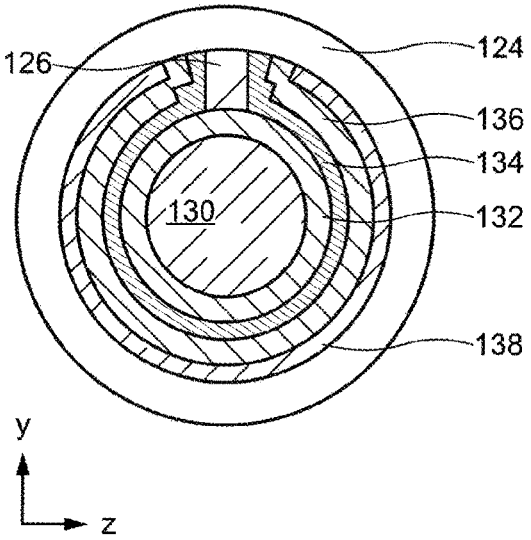
FIG. 9C is a schematic cross-sectional view of a lighting device according to an embodiment of the present invention.

The lighting device 120 may have a linear shape. A perspective view of the lighting device 120 having a linear shape is shown in FIG. 9A, while schematic cross-sectional views of a yz plane perpendicular to a longitudinal direction (x direction in FIG. 9A) are shown in FIG. 9B and FIG. 9C, and a schematic cross-sectional view of a xy plane is shown in FIG. 10. Note that a part of the components is omitted in FIG. 9A in order to clearly show the internal structure. As demonstrated in FIG. 9A to FIG. 9C, the linear lighting device 120 has the linearly extending first electrode 130 as well as the first light-emitting layer 132, the ionic-liquid layer 134, the second light-emitting layer 136, the second electrode 138, and the counter substrate 124 each extending linearly and having a tubular shape. The first light-emitting layer 132 is formed so as to surround an outer surface of the first electrode 130. In a similar way, the ionic-liquid layer 134, the second light-emitting layer 136, the second electrode 138, and the counter substrate 124 are formed so as to respectively surround the first light-emitting layer 132, the ionic-liquid layer 134, the second light-emitting layer 136, and the second electrode 138. Both edge portions of the lighting device 120 are sealed with the sealing layer 126 (FIG. 10). An opening 129 is formed in the sealing layer 126 provided at one edge portion in order to achieve an electrical contact with the first electrode 130. Similarly, an opening 131 is also formed in the counter substrate 124 to obtain an electrical contact with the second electrode 138.

As shown in FIG. 9A to FIG. 9C, the sealing layer 126 is in contact with a part of an outer surface of the first light-emitting layer 132, is sandwiched between the first light-emitting layer 132 and the counter substrate 124 and extends in the x direction. The sealing layer 126 may be in contact with side surfaces of the ionic-liquid layer 134, the second light-emitting layer 136, and the second electrode 138 (FIG. 9B), or the ionic-liquid layer 134 may be charged between the sealing layer 126 and the side surfaces of the second light-emitting layer 136 (FIG. 9C).

Figure 11A:
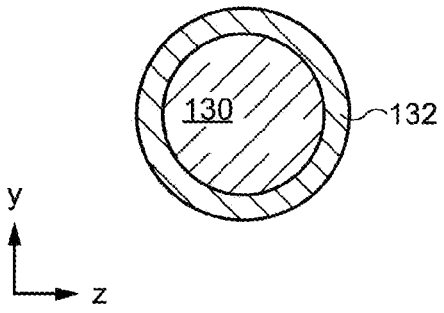
FIG. 11A is a schematic cross-sectional view showing a manufacturing method of a lighting device according to an embodiment of the present invention.
Figure 11B:
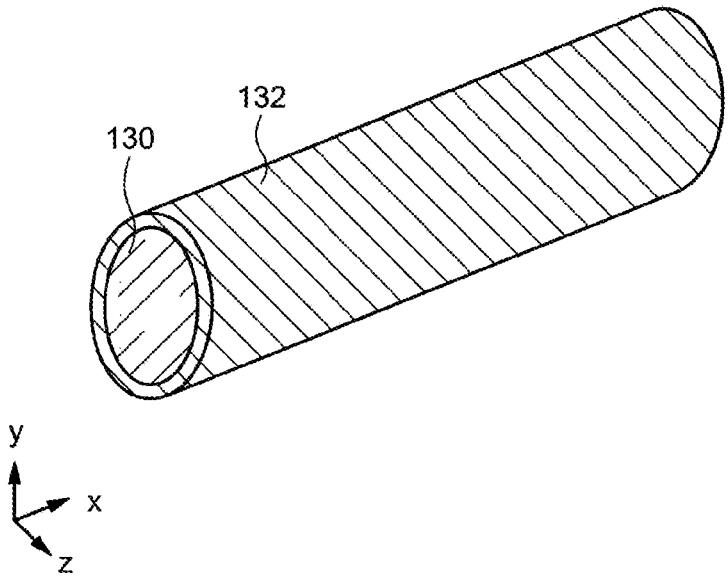
FIG. 11B is a schematic perspective view showing a manufacturing method of a lighting device according to an embodiment of the present invention.

The lighting device 120 having such a linear shape can be manufactured by the following method. First, the outer surface of the first linear electrode 130 is coated with the first light-emitting layer 132 as shown in FIG. 11A and FIG. 11B. The coating may be conducted with a dip-coating method, a spray-coating method, or the like.

Figure 12A:
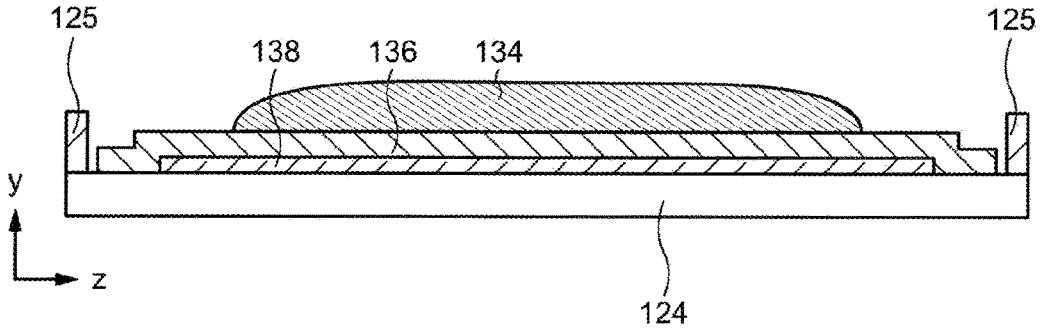
FIG. 12A is a schematic cross-sectional view showing a manufacturing method of a lighting device according to an embodiment of the present invention.
Figure 12B:
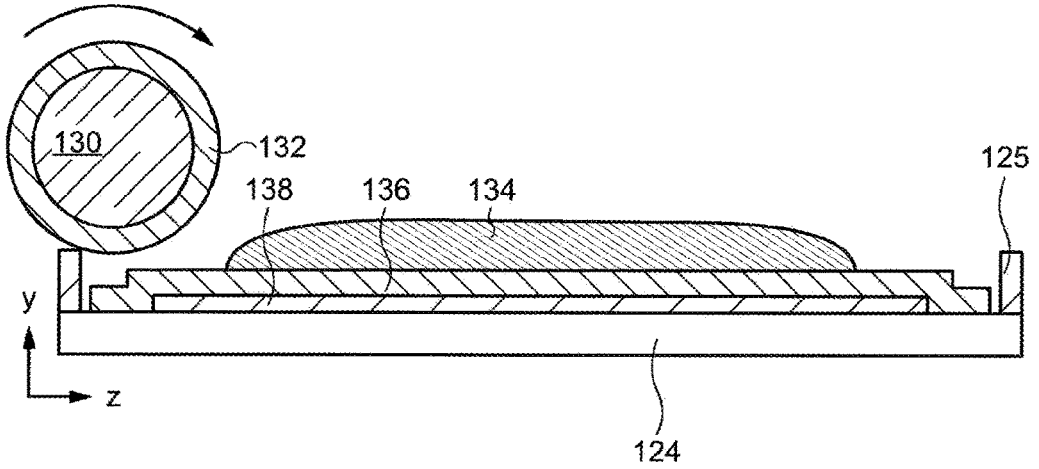
FIG. 12B is a schematic cross-sectional view showing a manufacturing method of a lighting device according to an embodiment of the present invention.
Figure 12C:
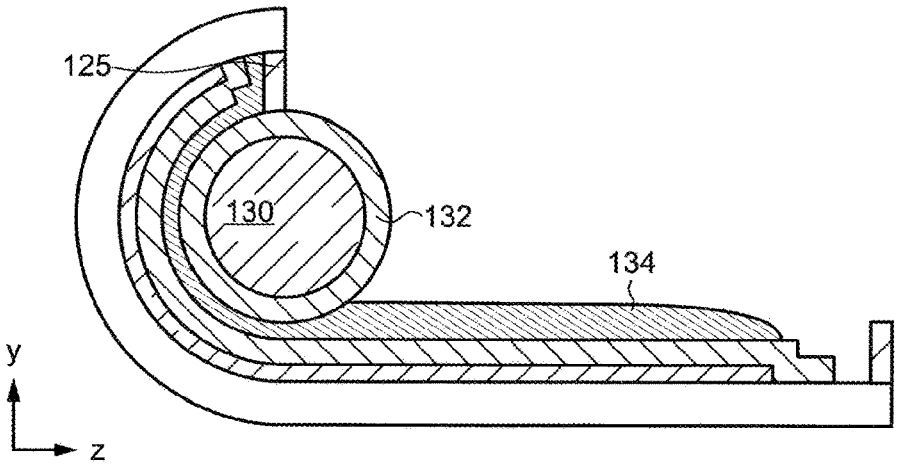
FIG. 12C is a schematic cross-sectional view showing a manufacturing method of a lighting device according to an embodiment of the present invention.

The flexible counter substrate 124 is provided over a supporting substrate, which is not illustrated, over which the second electrode 138, the resin 125 disposed to surround the second electrode 138, and the second light-emitting layer 136 over the second electrode 138 are formed (FIG. 12A). Although not illustrated, the resin 125 is formed over the counter substrate 124 so as to have a closed shape. These components may be formed by applying the aforementioned methods (see FIG. 4A and FIG. 4B). After that, the ionic-liquid layer 134 is dropped and spread over the second light-emitting layer 136 (FIG. 12A), and the first electrode 130 coated with the first light-emitting layer 132 is arranged over the counter substrate 124 so as to be in contact with the resin 125 as shown in FIG. 12B. When the first electrode 130 is rotated in this state as depicted by an arrow, the adhesion of the uncured resin 125 allows the counter substrate 124 to be peeled from the supporting substrate, and the counter substrate 124, the second electrode 138, and the second light-emitting layer 136 are simultaneously wound on an outer peripheral surface of the first electrode 130 (FIG. 12C). Light such as a laser may be applied onto the supporting substrate before arranging or rotating the first electrode 130 to reduce the adhesion between the supporting substrate and the counter substrate 124.

The first electrode 130 is rotated once, and the resin 125 is cured in a state where the outer peripheral surface of the first electrode 130 is entirely wound by the counter substrate 124, the second electrode 138, the second light-emitting layer 136, and the ionic-liquid layer 134 to form the sealing layer 126. With this process, the first light-emitting layer 132, the ionic-liquid layer 134, the second light-emitting layer 136, and the second electrode 138 are fixed to the outer peripheral surface of the first electrode 130. After that, the openings 129 and 131 are formed, thereby resulting in the lighting device 120 with a linear shape.

The use of a flexible metal wire as the second electrode 138 also enables the formation of the arbitrarily deformable lighting device 120 having a linear shape.

Third Embodiment

In the present embodiment, a display device 140 in which the lighting device 120 having the light-emitting element 100 is used as a backlight unit is explained. An explanation of the structures the same as or similar to those described in the First and Second Embodiments may be omitted.

Figure 13:
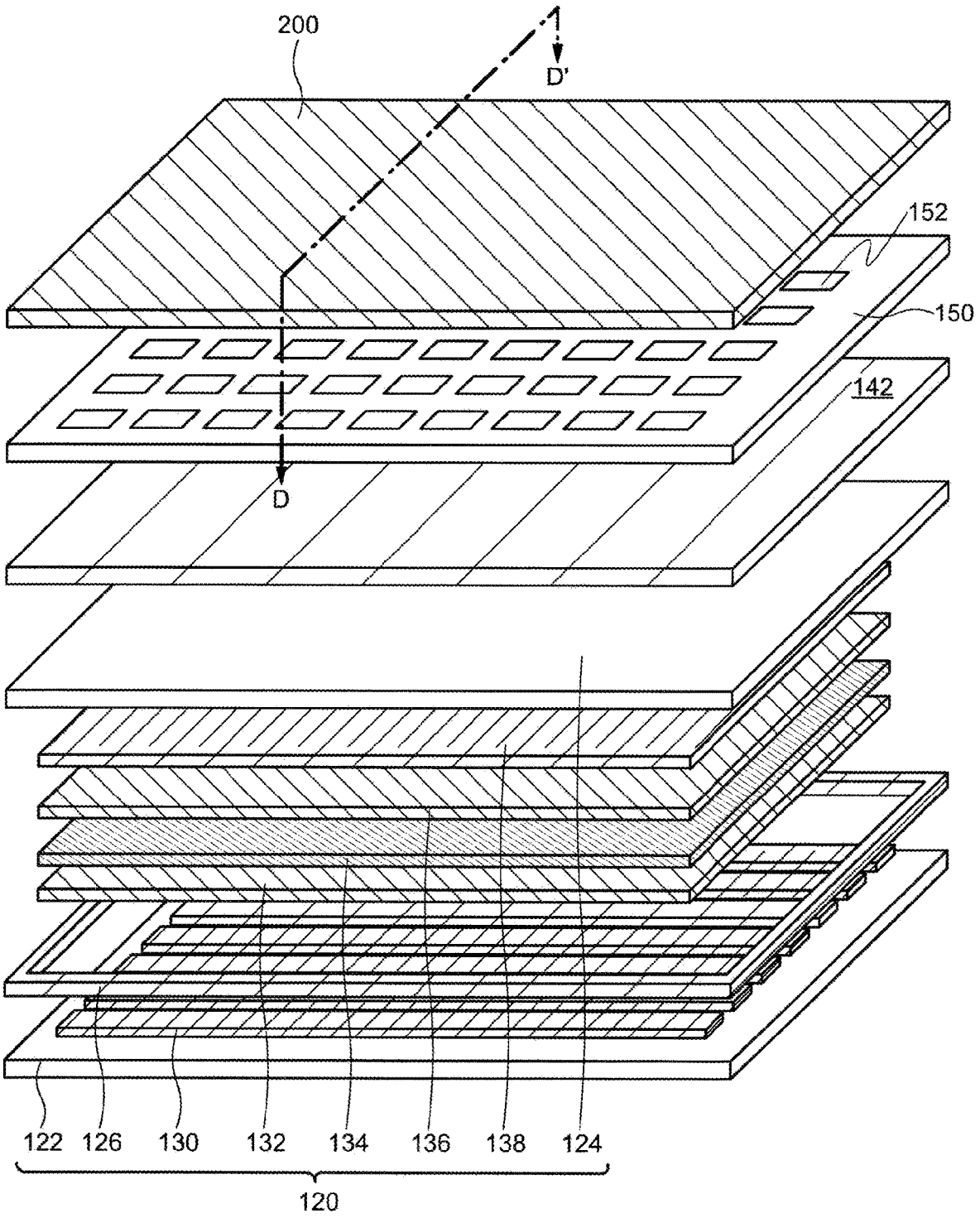
FIG. 13 is a schematic developed view of a display device according to an embodiment of the present invention.

A developed view of the display device 140 is shown in FIG. 13. The display device 140 has the lighting device 120 described in the Second Embodiment as a backlight unit, over which a liquid crystal module 150 is provided through an optical sheet 142. A plurality of pixels is formed in the liquid crystal module 150, and gradation is provided to the light from the lighting device 120 by the pixels 152. As an optional structure, the display device 140 may include a touch sensor 200 over the liquid crystal module 150.

Figure 14:
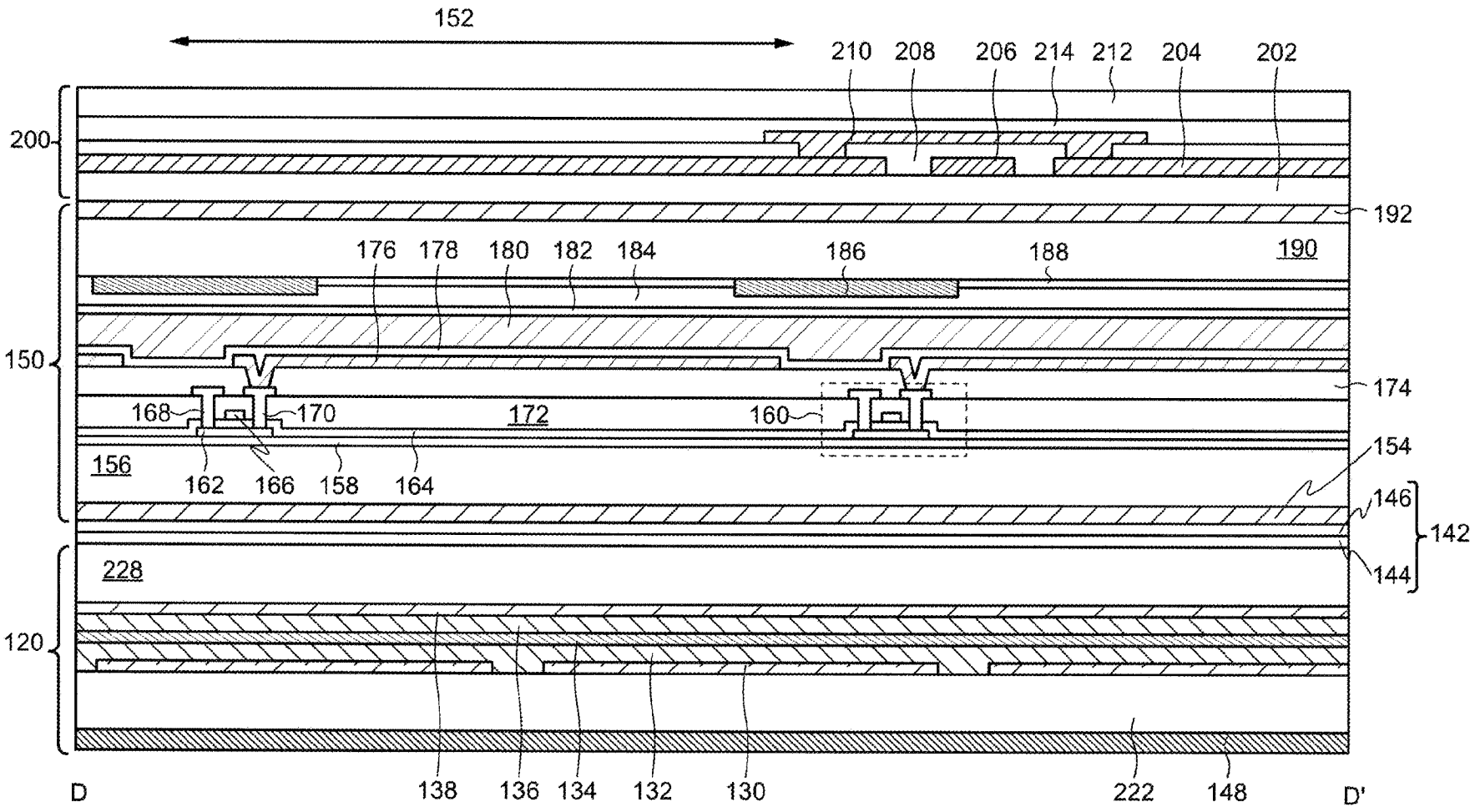
FIG. 14 is a schematic cross-sectional view of a display device according to an embodiment of the present invention.

A part of a cross section along a chain line D-D' in FIG. 13 is schematically shown in FIG. 14. FIG. 14 is a schematic cross-sectional view along two pixels 152. As shown in FIG. 14, a reflection film 148 is disposed under an array substrate 222 of the lighting device 120 functioning as a backlight unit, by which the emission obtained from the first light-emitting layer 132 and the second light-emitting layer 136 can be efficiently emitted toward the side of the liquid crystal module 150. Alternatively, the first electrode 130 capable of reflecting visible light may be provided as a single film without forming the reflection film 148.

The optical sheet 142 is arranged over the lighting device 120. The structure of the optical sheet 142 may be arbitrarily determined, and a stack of a prism sheet 144 and a light-diffusing film 146 may be used as the optical sheet 142, for example. The prism sheet 144 is provided in order to collect and radiate the light emitted from the lighting device 120 toward the front direction of the liquid crystal module 150, and a plurality of prism-shaped depressions and projections is arranged in a stripe form on a surface of the prism sheet 144. The light-diffusing film 146 is a component to uniform the light and may include light-diffusing particles and a polymer matrix fixing the particles. Although not illustrated, the optical sheet 142 may be fixed to the lighting device 120 using an adhesive.

There is also no limitation to the structure of the liquid crystal module 150. For example, the liquid crystal module 150 has the array substrate 156 over which transistors 160 are formed through an undercoat 158. The transistor is structured by a semiconductor film 162, a gate insulating film 164, a gate electrode 166, an interlayer film 172, a source electrode 168, a drain electrode 170, and the like, for example. Although not illustrated, a plurality of transistors and capacity elements may be arranged in each pixel 152 of the array substrate 156.

The transistors 160 are covered with a leveling film 174 and are electrically connected to pixel electrodes 176 provided over the leveling film 174. The pixel electrode 176 is arranged in each pixel 152. An orientation film 178 is formed over the pixel electrodes 176. A counter substrate 190 is disposed over the array substrate 156 through a liquid crystal layer 180. The structure of the counter substrate 190 may also be arbitrarily selected, and color filters 188, a black matrix 186, and an overcoat 184 covering these components may be formed over the counter substrate 190 as shown in FIG. 14. An orientation film 182 is disposed to cover the overcoat 184, and an initial orientation of liquid crystal molecules structuring the liquid crystal layer 180 is determined by the orientation films 178 and 182. A pair of polarizing plates 154 and 192 are further provided to sandwich the liquid crystal module 150.

In the example demonstrated in FIG. 14, the liquid crystal module 150 has the so-called TN (Twist Nematic) liquid crystal elements or VA (vertical Alignment) liquid crystal elements. However, the liquid crystal module 150 may include FFS (Fringe Field Switching) liquid crystal elements or IPS (In-plane Switching) liquid crystal elements.

The structure of the touch sensor 200 may also be arbitrarily determined, and an electrostatic capacitive type touch sensor may be employed. In this case, a first interlayer film 202 is formed over the liquid crystal module 150, over which a plurality of $T_x$ electrodes 204 and a plurality of $R_x$ electrodes 206 arranged to intersect each other are formed. Although a detailed explanation is omitted, the $T_x$ electrodes and the $R_x$ electrodes are each structured by a plurality of electrodes and are formed in the same plane (that is, over the first interlayer film 202). A second interlayer film 208 is disposed over the $T_x$ electrodes and the $R_x$ electrodes, and the adjacent electrodes included in each $T_x$ electrode are electrically connected with a bridge electrode 210. A protection substrate 212 for protecting the touch sensor 200 is provided over the bridge electrode 210 through a third interlayer film 214.

As described in the Second Embodiment, the lighting device 120 according to an embodiment of the present invention has high reliability and can be manufactured at a low cost due to the structure and the manufacturing method thereof. Hence, implementation of the present embodiment allows the production of a highly reliable display device at a low cost.

Fourth Embodiment

In the present embodiment, a structure of a self-emission type display device 220 including the light-emitting element 100 is explained. An explanation of the structures the same as or similar to those described in the First to Third Embodiments may be omitted.

Figure 15:
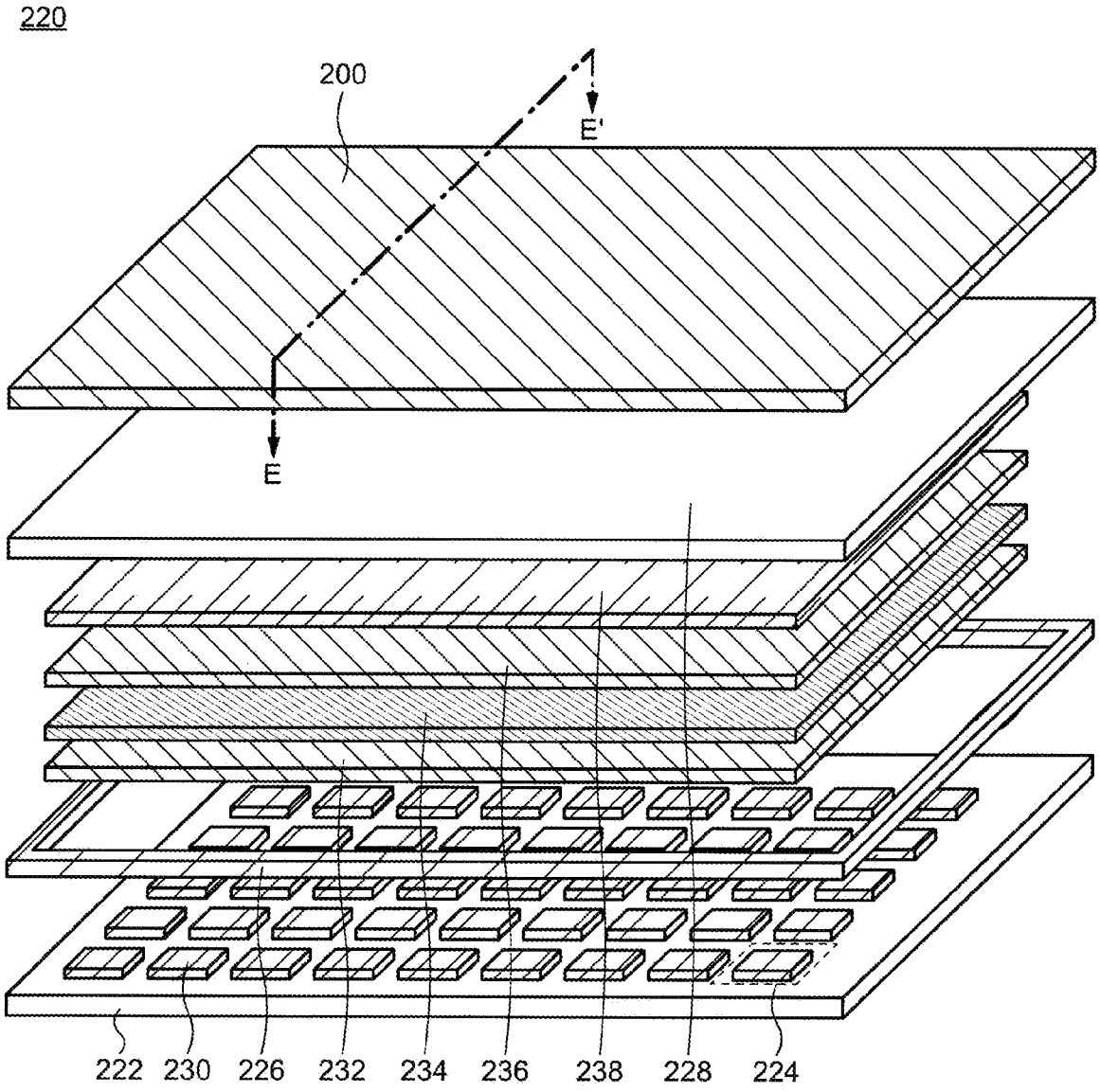
FIG. 15 is a schematic developed view of a display device according to an embodiment of the present invention.

A developed view of the display device 220 is depicted in FIG. 15. The display device 220 has an array substrate 222 (first substrate) over which a plurality of pixels 224 each including a first electrode 230 functioning as a pixel electrode is formed, where a sealing layer 226 surrounding the first electrodes 230, a first light-emitting layer 232, an ionic-liquid layer 234, a second light-emitting layer 236, a second electrode 238, and a counter substrate (second electrode) 228 are provided over the array substrate 222. The first electrodes 230, the first light-emitting layer 232, the ionic-liquid layer 234, the second light-emitting layer 236, and the second electrode 238 respectively correspond to the first electrodes 110, the first light-emitting layer 112, the ionic-liquid layer 114, the second light-emitting layer 116, and the second electrode 118 of the light-emitting element 100 and structure a light-emitting electrochemical cell. That is, the light-emitting element 100 is arranged in each pixel 224. The sealing layer 226 corresponds to the sealing layer 126 of the lighting device 120. Similar to the display device 140, the display device 220 may also include the touch sensor 200 as an optional component.

Figure 16:
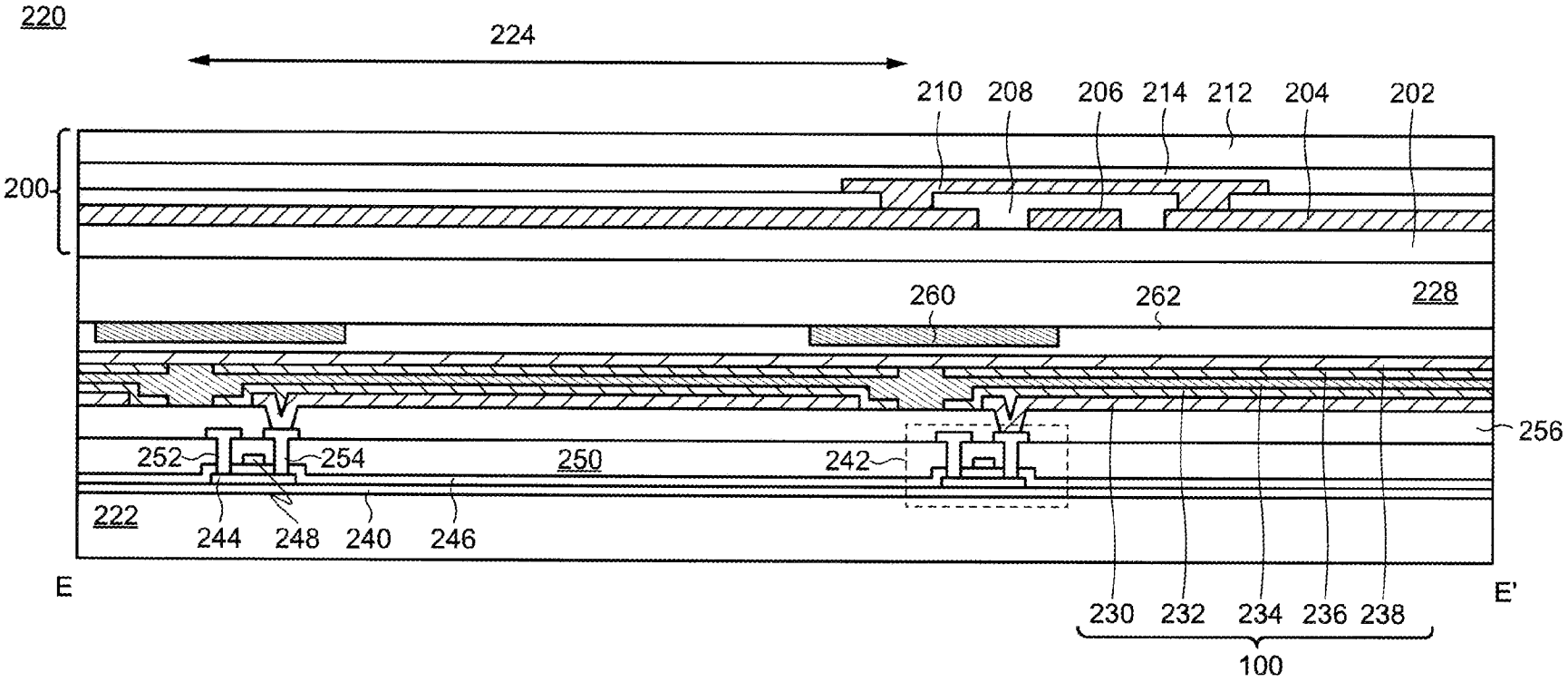
FIG. 16 is a schematic cross-sectional view of a display device according to an embodiment of the present invention.

A part of a cross section along a chain line E-E' in FIG. 15 is schematically shown in FIG. 16. FIG. 16 is a schematic cross-sectional view along two pixels 224. There is no limitation to the structure of the array substrate 222, and transistors 242 are disposed over the array substrate 222 through an undercoat 240 as shown in FIG. 16, for example. The transistor 242 is structured by a semiconductor film 244, a gate insulating film 246, a gate electrode 248, an interlayer film 250, a source electrode 252, a drain electrode 254, and the like, for example. Although not illustrated, a plurality of transistors and capacitor elements may be arranged in each pixel 224.

The transistors 242 are covered by a leveling film 256 and are electrically connected to the first electrodes 230 located over the leveling film 256. The first light-emitting layer 232, the ionic-liquid layer 234, the second light-emitting layer 236, the second electrode 238, and the counter substrate 228 are disposed over the first electrodes 230. A black matrix 260 and an overcoat 262 covering the black matrix 260 may be formed over the counter substrate 228. In this case, the second electrode 238 is formed over the counter substrate 228 through the overcoat 262. Although not illustrated, an undercoat may be interposed between the counter substrate 228 and the black matrix 260 or between the counter substrate 228 and the overcoat 262.

Here, although the first light-emitting layer 232 may be formed as a single layer shared by all of the pixels 224, the first light-emitting layer 232 is preferred to be formed in every pixel 224 so that the structures of the emissive polymers included are different between the pixels 224. In a similar way, although the second light-emitting layer 236 may be formed as a single layer shared by all of the pixels 224, the second light-emitting layer 236 is preferred to be formed in every pixel 224 so that the structures of the emissive polymers included are different between the pixels 224. In these cases, the first light-emitting layer 232 and the second light-emitting layer 236 are formed in every pixel 224 utilizing an ink-jet method or a printing method. Hence, the first light-emitting layer 232 may be separated between the adjacent pixels 224, and the second second-emitting layer 236 may also be separated between the adjacent pixels 224. Full color display can be realized by structuring the first light-emitting layer 232 and the second second-emitting layer 236 so that continuously arranged three pixels 224 or arbitrarily selected three pixels 224 respectively provide red, green, and blue emissions.

Although not illustrated, the display device 220 can also be manufactured by a similar method to that of the lighting device 120 described in the Second Embodiment. That is, a resin functioning as a raw material of the sealing layer 226 is formed to surround the plurality of first electrodes 230 arranged over the array substrate 222, and the first light-emitting layer 232 is further formed over the first electrodes 230 by utilizing an ink-jet method, a printing method, or the like. The second light-emitting layer 236 is also prepared over the second electrode 238 arranged over the counter substrate 228. After that, the ionic liquid is dropped in the region surrounded by the resin to form the ionic-liquid layer 234 over the first light-emitting layer 232. Then, the array substrate 222 and the counter substrate 228 are bonded to each other to sandwich the first light-emitting layer 232, the ionic-liquid layer 234, and the second light-emitting layer 236, and the resin is cured to form the sealing layer 226 and simultaneously fix the array substrate 222 and the counter substrate 228. Note that the resin may be formed over the counter substrate 228. In this case, the ionic-liquid layer 134 is applied to or dropped on the second light-emitting layer 236.

The aforementioned manufacturing method is the same as the manufacturing method of the lighting device 120. Therefore, implementation of the present embodiment enables the low-cost production of the display device 220 in which a highly reliable light-emitting element is arranged in each pixel 224.

Fifth Embodiment

In the present embodiment, a light-emitting element 106 different in structure from the light-emitting element 100 described in the First Embodiment is explained. An explanation of the structures the same as or similar to those described in the First to Fourth Embodiments may be omitted. The light-emitting element 106 is different from the light-emitting element 100 in that a plurality of conductive particles 113 is included in at least one of the ionic-liquid layer 114, the first light-emitting layer 112, and the second light-emitting layer 116. The conductive particles 113 may include a metal such as gold, silver, copper, and nickel or an alloy including a metal selected therefrom.

Figure 17A:
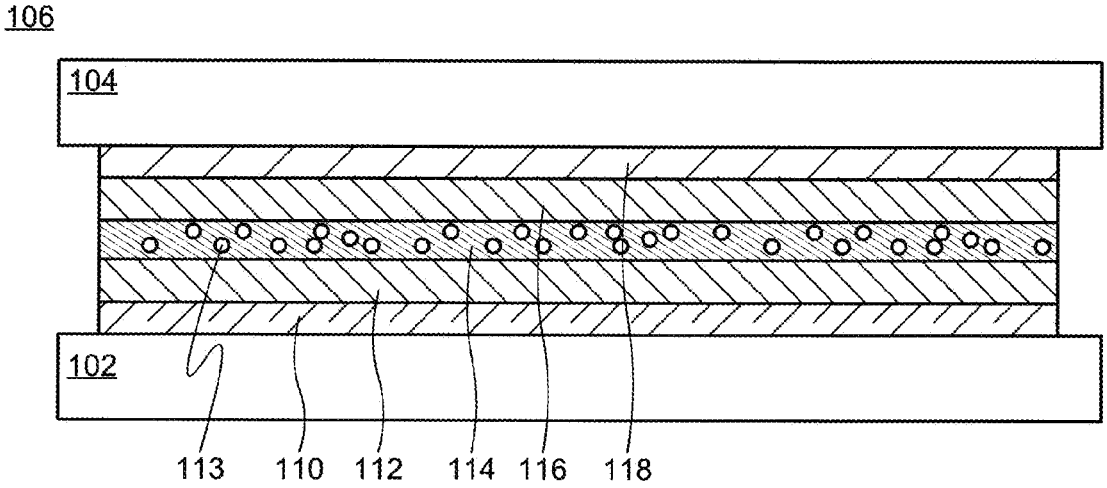
FIG. 17A is a schematic cross-sectional view of a light-emitting element according to an embodiment of the present invention.

For example, the light-emitting element 106 includes the conductive particles 113 in the ionic-liquid layer 114 as shown in FIG. 17A. An average particle size (average diameter) of the conductive particles 113 is equal to or less than the thickness of the ionic-liquid layer 114 and is selected from a range equal to or more than 5 nm and equal to or less than 20 nm or equal to or more than 5 nm and equal to or less than 15 nm. The ionic-liquid layer 114 may be configured so that the conductive particles are included in the ionic-liquid layer 114 at a concentration equal to or less than 10 wt %, preferably equal to or more than 0.5 wt % and equal to or less than 3 wt %.

The ionic-liquid layer 114 including the conductive particles 113 may be formed by adding the conductive particles 113 to the ionic liquid to be dispersed, followed by dropping or applying the resulting dispersion over the first light-emitting layer 112 or the second light-emitting layer 116 with an ODF method, a spray method, an ink-jet method, a printing method, a spin-coating method, or the like.

Figure 17B:
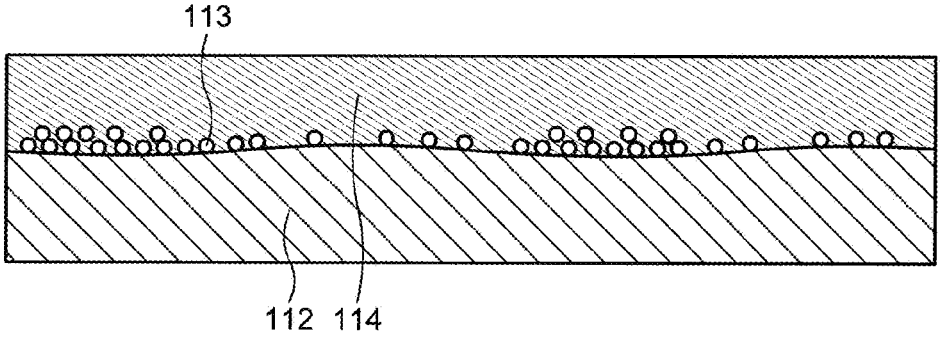
FIG. 17B is a schematic cross-sectional view of a light-emitting element according to an embodiment of the present invention.

The conductive particles 113 may be uniformly dispersed in the ionic-liquid crystal layer 134 but may be non-uniformly dispersed. For example, the conductive particles 113 may be localized on one of the sides of the first light-emitting layer 112 and the second light-emitting layer 116 as shown in FIG. 17B. Alternatively, when there are depressions and projections on the first light-emitting layer 112 or the second light-emitting layer 116, the conductive particles 113 may be dispersed in the depressions at a higher density. Arrangement of the conductive particles 113 in the depressions at a higher density relaxes the non-uniformity of the surface of the first light-emitting layer 112 or the second light-emitting layer 116, allowing the formation of the first light-emitting layer 112 or the second light-emitting layer 116 with a uniform thickness. Accordingly, emission with uniform luminance can be obtained in the emission region corresponding to the region in which the first electrode 112 and the second electrode 118 overlap each other. The substrate 102 may be vibrated or irradiated with ultrasonic waves after the dispersion including the ionic liquid and the conductive particles 113 is dropped or applied onto the first light-emitting layer 112 or the second light-emitting layer 116 in order to arrange the conductive particles 113 in the depressions of the first light-emitting layer 112 or the second light-emitting layer 116 at a higher density.

Figure 18A:
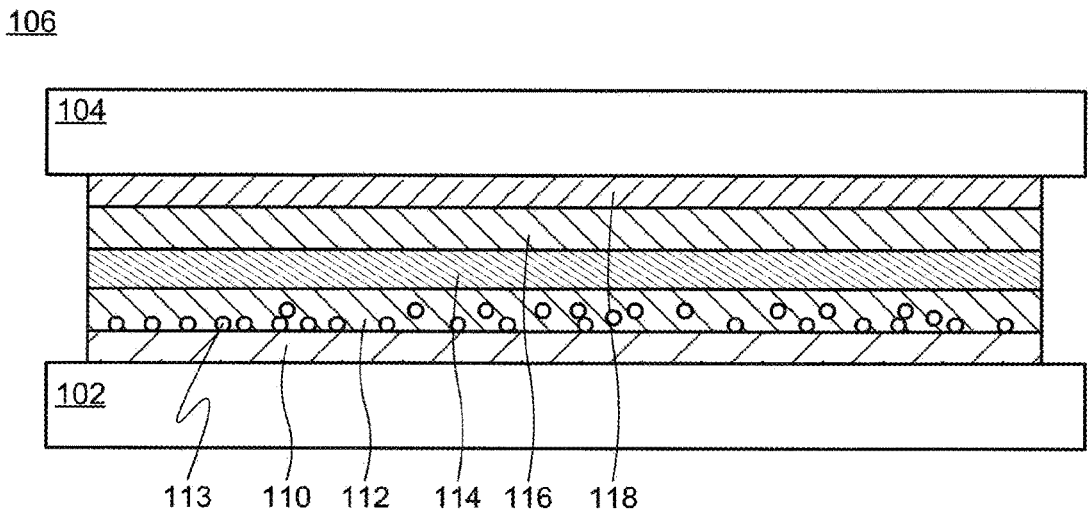
FIG. 18A is a schematic cross-sectional view of a light-emitting element according to an embodiment of the present invention.
Figure 18B:
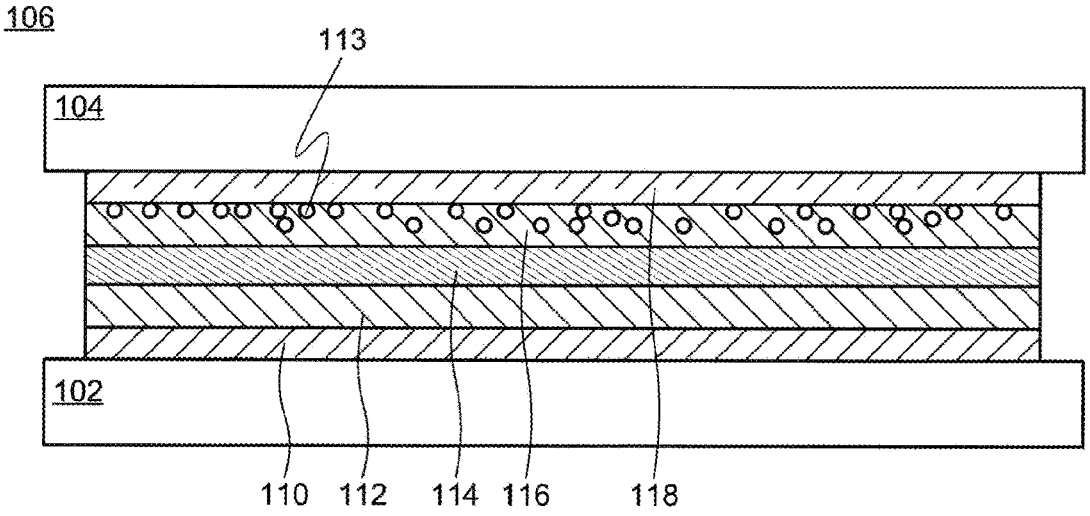
FIG. 18B is a schematic cross-sectional view of a light-emitting element according to an embodiment of the present invention.

As shown in FIG. 18A and FIG. 18B, the conductive particles 113 may be included in both or one of the first light-emitting layer 112 and the second light-emitting layer 116. In these cases, the average particle size of the conductive particles 113 is also equal to or less than the thickness of the first light-emitting layer 112 or the second light-emitting layer 116 and is selected from a range equal to or more than 5 nm and equal to or less than 20 nm. The first light-emitting layer 112 and the second light-emitting layer 116 may be configured so that the conductive particles 113 are included in the first light-emitting layer 112 or the second light-emitting layer 116 at a concentration equal to or less than 10 wt %, preferably equal to or more than 0.5 wt % and equal to or less than 3 wt %, for example.

Similar to the ionic-liquid layer 234 including the conductive particles 113, the first light-emitting layer 112 and the second light-emitting layer 116 including the conductive particles 113 may be formed by dispersing the conductive particles 113 into a mixture containing the emissive polymer, an organic solvent, and the ionic liquid and applying the resulting dispersion onto the first electrode 110 or the second electrode 118 with a spin-coating method, a spray method. an ink-jet method, a printing method, or the like, followed by evaporating the organic solvent.

Alternatively, the conductive particles 113 may be arranged over the first electrode 110 or the second electrode 118 before forming the first light-emitting layer 112 or the second light-emitting layer 116. Specifically, a suspension in which the conductive particles 113 are dispersed in an organic solvent or water is used, and the dispersion is applied over the first electrode 110 or the second electrode 118 using a spin-coating method, a spray method, an ink-jet method, a printing method, or the like. After that, the organic solvent or water is evaporated, thereby arranging the conductive particles 113 over the first electrode 110 or the second electrode 118. After that, a mixture containing the emissive polymer, the organic solvent, and the ionic liquid is dropped or applied to provide the first light-emitting layer 112 or the second light-emitting layer 116.

Figure 18C:
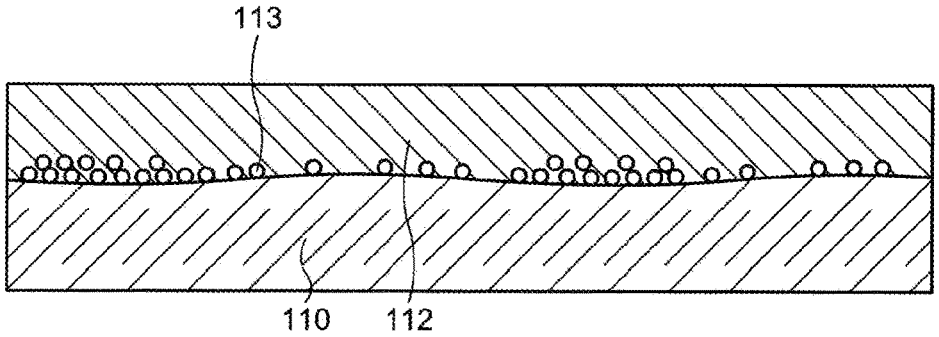
FIG. 18C is a schematic cross-sectional view of a light-emitting element according to an embodiment of the present invention.

Similar to the ionic-liquid layer 234, the conductive particles 113 may be uniformly or non-uniformly dispersed in the first light-emitting layer 112 or the second light-emitting layer 116. For example, the conductive particles 113 may be localized on the side of the first electrode 110 in the first light-emitting layer 112 and may be localized on the side of the second electrode 118 in the second light-emitting layer 116 as shown in FIG. 18A and FIG. 18B. Alternatively, when there are depressions and projections on the first electrode 110, the conductive particles 113 may be dispersed in the depressions at a higher density (FIG. 18C). Although not illustrated, in the case where there are depressions and projections on the second electrode 118, the conductive particles 113 may be dispersed in the depressions thereof at a higher density. Arrangement of the conductive particles 113 in the depressions of the first electrode 110 or the second electrode 118 at a higher density improves the flatness of the first electrode 110 or the second electrode 118 even if the flatness of the first electrode 110 or the second electrode 118 is low. As a result, it is possible to form the first light-emitting layer 112 or the second light-emitting layer 116 having a uniform thickness in the emission region, by which emission with uniform luminance can be obtained in the emission region. The substrate 102 may be vibrated or irradiated with ultrasonic waves after a dispersion including the emissive polymer, an organic solvent, the ionic liquid, and the conductive particles 113 or a dispersion in which the conductive particles 113 are dispersed in an organic solvent or water is applied onto the first electrode 110 or the second electrode 118 in order to arrange the conductive particles 113 in the depressions of the first light-emitting layer 112 or the second light-emitting layer 116 at a higher density.

The aforementioned modes described as the embodiments of the present invention can be implemented by appropriately combining with each other as long as no contradiction is caused. Furthermore, any mode which is realized by persons ordinarily skilled in the art through the appropriate addition, deletion, or design change of elements or through the addition, deletion, or condition change of a process is included in the scope of the present invention as long as they possess the concept of the present invention.

It is understood that another effect different from that provided by each of the aforementioned embodiments is achieved by the present invention if the effect is obvious from the description in the specification or readily conceived by persons ordinarily skilled in the art.

What is claimed is:

1. A light-emitting element comprising:

a first electrode;

a first light-emitting layer located over the first electrode and including a first emissive polymer and an ionic liquid;

an ionic-liquid layer located over the first light-emitting layer and including an ionic liquid;

a second light-emitting layer located over the ionic-liquid layer and including a second emissive polymer and an ionic liquid; and a second electrode over the second light-emitting layer.

2. The light-emitting element according to claim 1, further comprising:

a first substrate under the first electrode;

a second substrate over the second electrode; and a sealing layer located between the first substrate and the second substrate and surrounding the first electrode.

3. The light-emitting element according to claim 2, wherein at least one of the first substrate and the second substrate is a flexible substrate.

4. The light-emitting element according to claim 1, wherein the first emissive polymer and the second emissive polymer have the same structure.

5. The light-emitting element according to claim 1, wherein the first emissive polymer and the second emissive polymer are each a conjugated polymer.

6. The light-emitting element according to claim 1, wherein at least one of the first light-emitting layer, the ionic-liquid layer, and the second light-emitting layer further includes conductive particles.

7. A lighting device comprising:

a first substrate;

at least one first electrode over the first substrate;

a first light-emitting layer located over the at least one first electrode and including a first emissive polymer and an ionic liquid;

an ionic-liquid layer located over the first light-emitting layer and including an ionic liquid;

a second light-emitting layer located over the ionic-liquid layer and including a second emissive polymer and an ionic liquid;

at least one second electrode over the second light-emitting layer;

a second substrate over the at least one second electrode; and a sealing layer located between the first substrate and the second substrate and surrounding the at least one first electrode.

8. The lighting device according to claim 7, wherein the at least one first electrode includes a plurality of first electrodes arranged in a matrix form or a stripe form.

9. The lighting device according to claim 7, wherein the at least one second electrode includes a plurality of second electrodes arranged in a stripe form.

10. The lighting device according to claim 7, wherein at least one of the first substrate and the second substrate is a flexible substrate.

11. The lighting device according to claim 7, wherein at least one of the first light-emitting layer, the ionic-liquid layer, and the second light-emitting layer further includes conductive particles.

12. A method for manufacturing a lighting device, the method comprising:

forming a first electrode over a first substrate;

forming a resin surrounding the first electrode over the first substrate;

forming a first light-emitting layer including a first emissive polymer and an ionic liquid over the first electrode;

forming a second electrode over a second substrate;

forming a second light-emitting layer including a second emissive polymer and an ionic liquid over the second electrode;

forming an ionic-liquid layer including an ionic liquid over the first light-emitting layer or the second light-emitting layer;

bonding the first substrate and the second substrate so that the ionic-liquid layer is sandwiched by the first substrate and the second substrate; and curing the resin.

13. The method according to claim 12, wherein the first light-emitting layer is formed by applying a mixture of the first emissive polymer, the ionic liquid, and a first organic solvent followed by evaporating the first organic solvent, and the second light-emitting layer is formed by applying a mixture of the second emissive polymer, the ionic liquid, and a second organic solvent followed by evaporating the second organic solvent.

14. The method according to claim 12, wherein at least one of the first light-emitting layer, the ionic-liquid layer, and the second light-emitting layer further includes conductive particles.

15. The method according to claim 12, wherein at least one of the first substrate and the second substrate is a flexible substrate.

* * * * *